US011739453B2

(12) United States Patent
Miksch

(10) Patent No.: US 11,739,453 B2
(45) Date of Patent: Aug. 29, 2023

(54) METHOD FOR PREPARING SEWING GUIDE PATTERNS AND PATCHWORK COMPONENTS

(71) Applicant: Linda Susan Miksch, Normandy Park, WA (US)

(72) Inventor: Linda Susan Miksch, Normandy Park, WA (US)

( * ) Notice: Subject to any disclaimer, the term of this patent is extended or adjusted under 35 U.S.C. 154(b) by 391 days.

(21) Appl. No.: 16/656,340

(22) Filed: Oct. 17, 2019

(65) Prior Publication Data

US 2021/0115608 A1 Apr. 22, 2021

(51) Int. Cl.

| | |
|---|---|
| ***D05B 19/14*** | (2006.01) |
| ***D05C 5/02*** | (2006.01) |
| ***D05C 17/00*** | (2006.01) |
| ***D05B 69/10*** | (2006.01) |
| ***D05B 21/00*** | (2006.01) |

(52) U.S. Cl.

CPC ..... *D05B 19/14* (2013.01); *D05B 21/00* (2013.01); *D05B 69/10* (2013.01); *D05C 5/02* (2013.01); *D05C 17/00* (2013.01)

(58) Field of Classification Search

CPC ..... D05B 97/12; D05B 19/08; D05B 19/10; D05B 19/14; D05B 21/00; D05C 5/02

See application file for complete search history.

(56) References Cited

U.S. PATENT DOCUMENTS

| | | | | |
|---|---|---|---|---|
| 4,646,666 | A * | 3/1987 | Burrier | D05B 97/12 112/420 |
| 5,272,995 | A | 12/1993 | Harger | |
| 8,171,867 | B2 | 5/2012 | Roche | |
| 8,851,002 | B1 * | 10/2014 | Gardner | D05B 19/12 112/475.19 |
| 8,967,062 | B1 | 3/2015 | Gardner | |

* cited by examiner

*Primary Examiner* — Nathan E Durham

(57) ABSTRACT

Provided is a method for preparing sewing guide patterns suitable for constructing groups of patchwork components used in quilting. A rectangular sewing guide outer perimeter exactly includes either two or four congruent instances of rectangular, right-angle triangle or isosceles triangle patchwork components. A nested series of additional sewing guide elements are placed inside the rectangle where the points of each element are placed at the midpoints of the sides of the previous element. The number of elements is selected in consideration of aesthetic objectives. Final sewing guide patterns are prepared by adding a space equal to two times a seam allowance between each of the shared sides of the contiguous instances of the patchwork components in the rectangle and added elements. The pattern is suitable for assembling a plurality of patchwork components by methods known in the art as foundation piecing. The components are released by cutting between the added spaces.

1 Claim, 18 Drawing Sheets

METHOD FOR PREPARING SEWING GUIDE PATTERNS AND PATCHWORK COMPONENTS

FIELD OF THE INVENTION

Aspects relate generally to methods for preparing patchwork components comprised of two or more pieces of fabric joined together by sewing, and in more particular aspects for simultaneously producing a plurality of patchwork components for use in quilting using foundation piecing sewing methods executed by hand or by using sewing machines, software-driven sewing and embroidery machines, and the like.

CROSS-REFERENCE TO RELATED APPLICATIONS

Not Applicable.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

As an exemplary sewing product, patchwork quilts are a finished fabric product typically consisting of three layers: the top fabric or quilt top, backing material and batting (filler, sandwiched between the top and backing materials to give the quilt loft). The quilt tops are generally formed by joining together multiple quilt blocks, usually square and often repeated. The quilt blocks typically are assembled from a plurality of smaller pieces of fabric with contrasting colors and/or textures.

For many quilt blocks the pieces of fabric comprising the quilt block are arranged in a geometric pattern which is pleasing to the eye. The history of this approach is known to date back to at least American colonial times where the block-style pieced quilt was a functional solution to the necessity of resource poor early settlers to reuse fabrics which had become worn out in other applications such as blankets and clothing. Using a straight-edge and scissors or other cutting implements these settlers created quantities of fabric pieces having elementary shapes such as squares, rectangles, equal sided right angle triangles, equilateral triangles, rhombuses and the like. These fabric pieces were most efficiently utilized through repetition in geometric patterns, with the desire to create patterns pleasing to the eye a natural corollary.

Over time selected combinations of fabric pieces having elementary geometric shapes have come to be recognized as patchwork components and named in the art due to their repeated appearance in the geometric patterns. In particular there are recognized patchwork components based on triangles which include, but are not limited to, a Half Square Triangle consisting of a square formed by joining two equal right triangles, Pinwheels consisting of four Half Square Triangles arranged in a square with the diagonals meeting in the center and the colors alternating so that they appear to rotate around the square, Chevrons consisting of four half square triangles arranged in a square so that one color forms a 'v' shape, Flying Geese components consisting of an equal sided right angle triangle flanked by two smaller equal sided right angle triangles to form a rectangular whole, a Quarter Square Triangle consisting of a square formed by joining four equal sided right angles, and a Triangle In A Square which is similar to a Flying Geese unit but the final shape is square and the largest triangle is not a right angle triangle.

One disadvantage known in the art of patchwork quilt making is the enormous investment of time required to fabricate a quilt by piecing together individual fabric pieces to form the quilt blocks. The number of blocks in a finished quilt typically varies from about 10 to more than 100. A review of the compilation books shows that the number of pieces in a four-patch design can range from as few as 4 to more than 60, while a nine-patch design can range from as few as 9 to more than 80, and so on for other known geometric patterns. Thus, the number of fabric pieces required for constructing a patchwork quilt is typically not less than several hundred and may reach several thousand. It will be appreciated that the preparation of such numbers of individual fabric pieces using a straight-edge and scissors or other cutting implement is time consuming.

A second disadvantage is that it is difficult to prepare quantities of fabric pieces which are identical in their geometric characteristics such as length, width and angles between sides. This is especially true for fabric pieces whose shape incorporates angles other than right angles for which the use of straight-edges must be supplemented by use of angle rulers, rulers with angle markings, or application of geometric knowledge such as knowing that cutting a square on a diagonal will result in a 45° angle. When fabric pieces vary in their geometric characteristics the effect on the aesthetic quality of the finished quilt is deleterious. Though the geometric variations between any two pieces may be difficult to detect, differences can accumulate when assembling many pieces.

A third disadvantage is the difficulty in joining numerous pieces while maintaining a high degree of precision with respect to the geometric pattern being created. When many separate fabric pieces are assembled piece-by-piece errors may occur for any individual join, and small errors which are not noticeable in a single join can accumulate to produce overall errors. Common errors due to these two disadvantages that are recognized to occur include, but are not limited to, loss of symmetry in the overall assembly or portions thereof, points of the visible portion of one or more fabric pieces in an assembly that are cut off ("lost" in a joining sewing sewing), points which "float" in that they leave a gap instead of touching a sewing, two or more points which do not align with each other, and sewings between contiguous pieces not lining up.

In an effort to overcome these deficiencies methods known in the art have been developed which facilitate the preparation of many patchwork components simultaneously. Generally these methods rely on joining larger pieces of fabric into assemblies which comprise multiple patchwork components, and then releasing individual or joined patchwork components by cutting. The advantages generally lie in reducing the number of individual pieces of fabric that need to be prepared and the number of independent joining sewings that need to be executed.

One such method is strip piecing wherein two or more strips of fabric are sewn together along the long edges to form a larger composite strip piece with parallel rows. The composite strip may then be cut across the strips at various angles relative to the longitudinal edge to create square, rectangle, diamond or hexagon patchwork components with each shape comprised of the fabrics used to create the composite strip. One drawback of this method is that it is not suited to the fabrication of patchwork components having triangle shapes. A drawback of this method is that the versatility of utilizing the patchwork components is limited by the fact that they are already assembled in linear arrays A second drawback that it is difficult to sew long strips together in a parallel configuration without small variations in width. Singly and cumulatively, these small geometric variations lead to the errors described above which have a deleterious effect on the aesthetic quality of a finished quilt.

A second method, termed tube piecing, cuts a stripped piecing assemblage across the latitudinal edge at a precise angle and then sews together the opposing longitudinal edges. The result is an extended tube in which the strips of fabric have been reoriented in a diagonal orientation relative to the longitudinal edges. Precise latitudinal cuts perpendicular to the longitudinal edges yield a series of secondary tube strips which are then sewn together along their longitudinal edges to form a new strip piecing assemblage. Depending upon orientation selections made during initial assembly steps the assemblage can be cut apart to yield linear array patchwork components comprised of Half Square Triangles, Pinwheels or Chevron patterns. One drawback of this method is that the versatility of utilizing the patchwork components is limited by the fact that they are strictly assembled in linear arrays. A second drawback is that the range of patchwork components that can be created is limited. A third drawback is that the method has no provision for continuing the process and creating a series of increasingly complex patchwork components. A fourth drawback is that it is difficult to sew long strips together in a parallel configuration without small variations in width. Furthermore, exceptional skills are required to compute strip widths and cut angles so that both the patchwork components can be assembled, and lend themselves to further joining to form quilt blocks or other larger assemblies, on the basis of common seam allowance and joining practices. Therefore it is common when using this method to propagate geometric variations which singly and cumulatively lead to the errors described above which have a deleterious effect on the aesthetic quality of a finished quilt.

A third method is also termed tube strip piecing and consists of placing one strip on top of a second strip with the presentation sides facing each other, and the two strips are sewn together along both longitudinal edges. Half Square Triangles are then cut out of the assembly in alternating directions using an angled ruler.

In a fourth method, termed Magic 8 Half Square Triangles, one square of fabric is placed on top of another with the presentation sides facing each other and pairs of sewings are sewn along the two diagonals of the square. Each pair of sewings is separated by a space equal to two times a desired seam allowance. After the squares are joined cuts are made along the midline of the two pairs of sewings, releasing four half-square triangle patchwork components. These methods together have the drawback that they are limited to the fabrication of Half Square Triangle component pieces.

U.S. Pat. No. 5,272,995 (Harger) describes a method of constructing a quilt using foldable material specifically shaped to be folded and sewn together to make a quilt that appears to be made with a larger number of pieces than are actually used. However, this prior art is limited to a particular set of quilting patterns known as Log Cabins which consist of repeated strips of fabric surrounding a center patch to form square, rectangle, diamond, triangle or hexagonal quilt blocks or patchwork components.

Additional related art, known to practitioners in the field as 'foundation piecing', is described in U.S. Pat. No. 4,646,666 (Burlier) wherein fabric pieces are assembled with the aid of a backing material which includes a pattern having proposed stitching lines. U.S. Pat. No. 8,171,867 (Roche) describes a method for securing a quilt sandwich of top layer fabric, batting and backing fabric in an embroidery hoop and attaching said embroidery hoop to an embroidery machine. The user retrieves a digitized embroidery file that is fed into the embroidery machine. The digitized file instructs the embroidery machine to stitch the quilt layers together according to a predetermined stippling pattern and to stitch an outline for an applique. Further related art is described in U.S. Pat. No. 8,851,002 (Gardner) and U.S. Pat. No. 8,967,062 (Gardner) which describe a method for creating a quilt block includes securing a backing in an embroidery hoop and attaching the embroidery hoop to an embroidery machine. A block selection is provided to the embroidery machine. The block includes one or more pieces that form the block. Selection of the block also includes a set of instructions for sewing the pieces together to form the block. A placement pattern is sewed on the backing according to the instructions. Each piece of the block is placed on a corresponding portion of the placement pattern. The pieces are then sewed to the backing to form the block. No specific provisions or instructions are provided in these related arts to utilize specific patterns to facilitate the creation of patchwork composites above and beyond.

Accordingly, a need exists for a method to create a sewing guide pattern which facilitates the simultaneous assembly of a plurality of selected patchwork components recognized in the art, and which can be extended by orderly steps to create a series of sewing guide patterns which facilitate the assembly of related and increasingly complex patchwork components heretofore not easily accessible by piecing together individual fabric pieces or by recognized prior art for the preparation of many patchwork components simultaneously. It would be desirable for the patchwork components to be released individually to maximize the esthetic options available when they are incorporated into quilting designs. It would also be desirable for the sewing guide pattern to incorporate sewings which are no longer than approximately 1 to 2 times the dimensions of the patchwork components so as to remove the need to sew long strips together in a parallel configuration with the attendant difficulties in avoiding small geometric variations which lead to errors having a deleterious effect on the aesthetic quality of the patchwork components.

SUMMARY OF THE INVENTION

I have discovered a method for the fast and efficient preparation of geometrically related sets of either 2 or 4 patchwork components. The method is based on my discovery of a series of sewing patterns which are prepared by application of a simple set of orderly steps. To use my method, in a first step a user selects a finished patchwork component peripheral shape from among the shapes of a rectangle, a right-angle triangle or an isosceles triangle. In a second step the user selects the desired dimensions for the side of the patchwork component, generally selecting a shortest side of between 2" and 16" as is common in assembling patchwork components into quilting blocks. In a third step the user then prepares a rectangular sewing guide pattern which is sized to accommodate multiple congruent instances of the selected patchwork component shape and is either exactly two congruent rectangles sharing a side of equal length, or two congruent right angle triangles sharing a diagonal side, or four congruent rectangles sharing a common corner with adjacent rectangles sharing sides of equal length, or two pairs of congruent isosceles triangles sharing a common apex. In the case of isosceles triangles two of the triangles will be of the selected shape, and the other two will be used to fill in the rectangle. Thus, the final two triangles will share sides of equal length with the selected isosceles triangle shape and have an angle between the base and the shared sides equal to 90 degrees minus the angle between the base and shared sides of the selected isosceles triangle.

In a fourth step the user selects a member of my series based on aesthetic considerations for the finished patchwork component. The first member of the series is prepared by placing a rhombus sewing guide element inside the outer perimeter with the points of the rhombus placed at the midpoints of the sides of the outer perimeter rectangle. In a fifth step the series may be continued by sequentially adding new sewing guide elements, which alternate between rectangles and rhombuses, inside the initial rhombus where in each case the points of each new sewing guide element are placed at the midpoints of the sides of the immediately preceding sewing guide element. Typically the number of additional sewing guide elements placed inside the initial rhombus is between 0 and 4; however, there is no upper limit to the series provided that the innermost sewing element is at least two times the user determined working seam allowance, typically ¼".

In a sixth step the contiguous patchwork component shapes contained within the rectangular pattern are moved apart to create a space equal to two times a seam allowance. When the patchwork component shapes are rectangular, or are isosceles right triangles, the direction of movement is orthogonal to the shared sides of the shapes and is equal to two times a seam allowance. When the patchwork component shapes are other types of triangles the direction of movement is parallel to the lines of the added rhombus sewing guide elements which cross the boundary between the patchwork component shapes. Geometric considerations are applied to compute how far the shapes must be moved in order to create a space equal to two times a seam allowance measured orthogonally between the nearest sides of the shapes. As a matter of convenience, to facilitate the assembly of patchwork components by allowing continuous stitching along the lines of the final sewing guide pattern, in a seventh step straight line segments can be added between the endpoints of all lines which were split to again have continuous lines.

Completion of these seven steps yields one of my completed sewing patterns. Any member of my series of sewing patterns is defined by two parameters, the peripheral shape of the finished patchwork component and the number of internal sewing guide elements which are placed inside the outer perimeter rectangular pattern.

Once the sewing pattern is completed it may be used to construct an assembly consisting of a plurality of patchwork components by means known in the art, generally known as foundation piecing, which may be executed using a digital embroidery machine, paper piecing or fabric foundation piecing. Once the assembly of patchwork components has been constructed the individual patchwork components are released by cutting between the spaces that were added in the sixth step, leaving a seam allowance on each patchwork component piece. Depending upon the initial selection of a patchwork component peripheral shape and the subsequent preparation of a rectangular sewing guide the yield is patchwork components consisting of two rectangles (where it is understood that squares are a special instance of rectangles), four rectangles, two right angle triangles, four right angle triangles, or two pairs of isosceles triangles, respectively.

To use my method a user selects a finished component peripheral shape from among the shapes of a rectangle, a right-angle triangle or an isosceles triangle. The user then selects a rectangle which is sized to accommodate multiple congruent instances of the selected patchwork component shape and is either exactly two congruent rectangles sharing a side of equal length, or two congruent right angle triangles sharing a diagonal side, or four congruent rectangles sharing a common corner with adjacent rectangles sharing sides of equal length, or two pairs of congruent isosceles triangles sharing a common apex. The user then selects the number of additional sewing elements to be placed inside the rectangle in consideration of aesthetic objectives for the finished patchwork components. Following the steps above, the user is then able to create a sewing guide pattern and assemble, by methods generally known in the art as foundation piecing, a plurality of selected patchwork components. The sewing guide incorporates seams which are no longer than approximately 1 to 2 times the dimensions of the patchwork components and therefore the cumulative errors which have a deleterious effect on the aesthetic quality of the patchwork components associated with other methods which require sewing long strips together is avoided. The user releases individual patchwork components by cutting around the outer perimeter of my sewing pattern, leaving a seam allowance, and generally through the middle of the spaces that were added between the patchwork component shapes. The finished patchwork components have seam allowances on all sides, and there are no limitations on esthetic options available when the user incorporates the patchwork components into quilt designs.

One object of the present invention is to provide a method of making multiple patchwork components comprised of triangular, rectangular and square shapes simultaneously using only square and rectangular fabric pieces combined with basic sewing skills such as the ability to sew by machine along a marked straight-line or operate an embroidery machine.

Another object of the present invention is to provide a method of making multiple patchwork components more rapidly and efficiently than can be done by piecing together elementary fabric pieces.

Another object of the present invention is to provide a quick and easy method of making complex patchwork components comprised of triangular, rectangular and square shapes which were too labor-intensive when constructed by prior techniques to be recognized and named in the art.

Another object of the present invention is to provide a method of making complex patchwork components comprised of triangular, rectangular and square shapes which maintains a high degree of precision with respect to their geometric characteristics such as length, width and angles between sides, thereby reducing or eliminating single and cumulative errors which can be deleterious to the aesthetic quality of the patchwork components or larger assemblies of patchwork components such as quilt blocks or whole quilts.

Further objects and advantages of the present invention will be apparent from the following description and claims.

BRIEF DESCRIPTION OF THE DRAWINGS

Aspects of the invention will best be understood by reference to the following detailed description, as well as illustrative embodiments when the description is read in conjunction with the accompanying drawings.

Figure 1A:
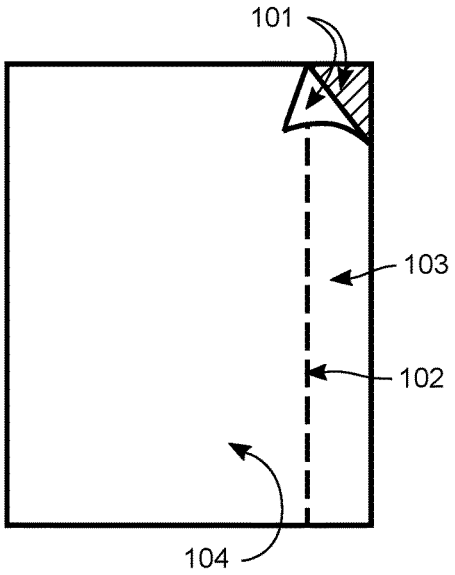
FIG. 1A (Prior Art)
FIG. 1A-1C show an exemplary seam allowance.

The following Reference Numbers may be used in conjunction with one or more of the accompanying FIGS. 1-14 of the drawings:

101 fabric side intended for presentation to viewer
102 line of stitching, illustration stroke style long dashes
103 seam allowance
104 fabric side which will be hidden from viewer
201 location of a future line of stitching, illustration stroke style dotted line
202 anticipated seam allowance associated with a future line of stitching
203 a cut of joined fabric pieces sized to anticipate a future line of stitching 201, and its associated seam allowance 202

DETAILED DESCRIPTION OF INVENTION

For the purposes of promoting an understanding of the principles of the invention, reference will now be made to selected aspects of prior art.

Figure 1B:
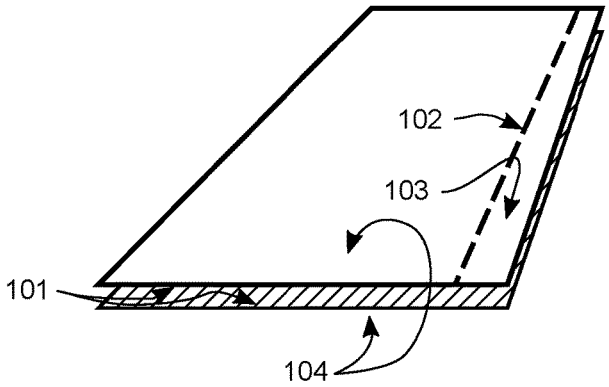
FIG. 1B (Prior Art)
Figure 1C:
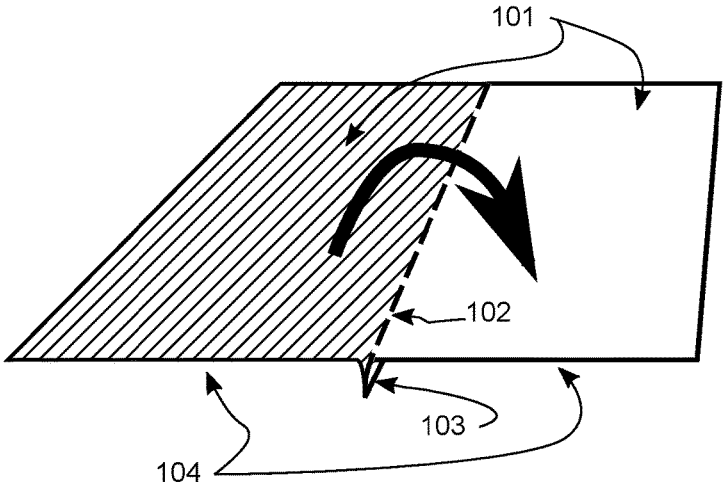
FIG. 1C (Prior Art)

The nature of a seam allowance is shown in FIG. 1. Per FIG. 1A one piece of fabric is placed on top of a second piece of fabric, with the final presentation sides of the fabric 101 placed so as to face each other. Per FIG. 1B the edges are aligned and the fabric is stitched together along a line of stitching 102, taking advantage of a seam allowance 103. Per FIG. 1C, once the fabric pieces are stitched together the construct is opened up to reveal the final presentation sides of the fabric 101 with the opposite sides of the fabric 104 hidden from view.

Figure 2A:
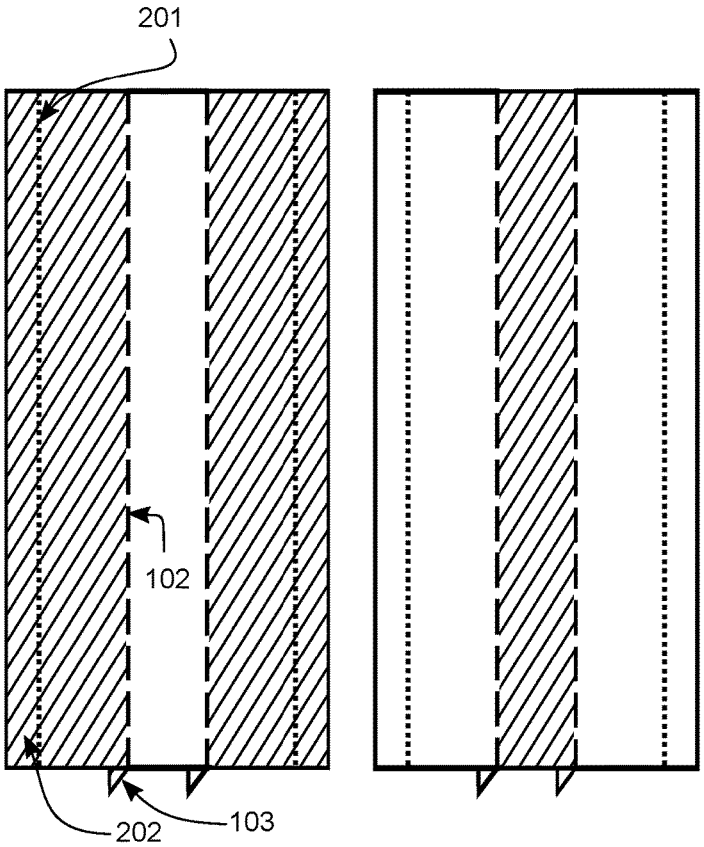
FIG. 2A (Prior Art)
FIG. 2A-2D illustrate a sequence for creating components comprised of square fabric pieces according to the prior art of strip piecing.
Figure 2B:
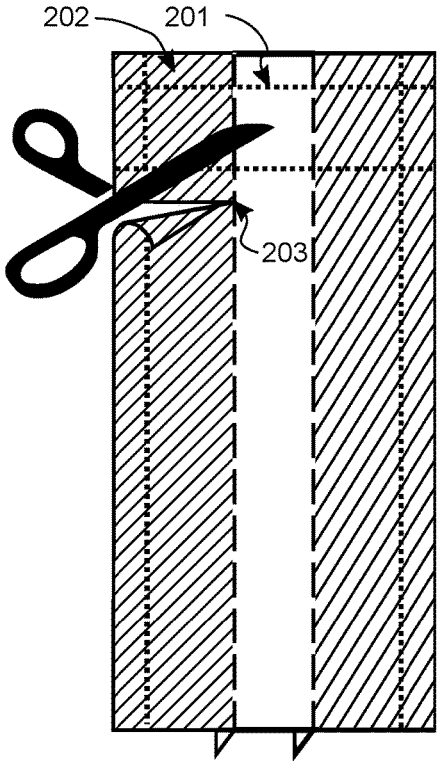
FIG. 2B (Prior Art)
Figure 2C:
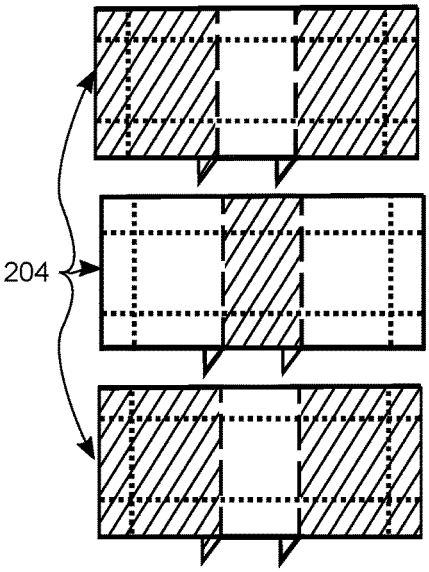
FIG. 2C (Prior Art)
Figure 2D:
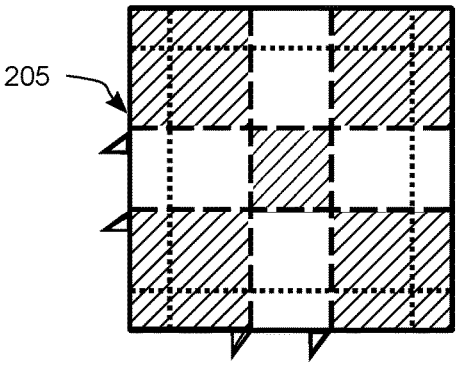
FIG. 2D (Prior Art)

FIG. 2A-2D show the method of assembling a plurality of patchwork components using the prior art of strip piecing. In FIG. 2A strips of fabric are joined together following the considerations shown in FIG. 1. The outermost strips are sized to anticipate a future line of stitching 201, and its associated seam allowance 202. In FIG. 2B 2C the joined strips are cut horizontally 203 to create patchwork components 204 which are sized to anticipate a second future line of stitching 201, and its associated seam allowance 202. FIG. 2D shows an illustrative example of how the patchwork components 204 may be further combined using the considerations shown in FIG. 1 to create a larger patchwork component or finished quilt block 205. It will be appreciated that the sequence of steps shown in FIG. 2A-2D may also be used to produce patchwork components comprised of rectangles or parallelograms by varying the width of the strips which are joined together and/or the angle at which the strips are cut 203. A disadvantage of the strip piecing method is that it does not facilitate the fabrication of patchwork components containing triangles. A second disadvantage is that the method has no provision for creating a progressively more complex patchwork components. A third disadvantage is that it is difficult to sew long strips together in a parallel configuration without introducing small variations in width. These variations lead to single and cumulative errors in geometric uniformity including, but not limited to, loss of symmetry, points that are cut off ("lost" in a sewing), points which "float" in that they leave a gap instead of touching a sewing, two or more points which do not align with each other, and seams between contiguous pieces not lining up. Singly or in combination, these errors are known in the art to have a deleterious effect on the esthetic quality of patchwork components, quilt blocks and finished quilts.

Figure 3A:
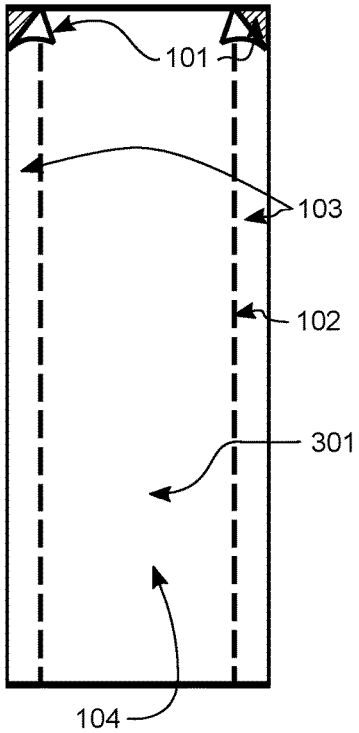
FIG. 3A (Prior Art)
FIG. 3A-3D illustrate a sequence for creating a plurality of Half Square Triangle patchwork components according to a particular variation of the prior art of strip piecing.
Figure 3B:
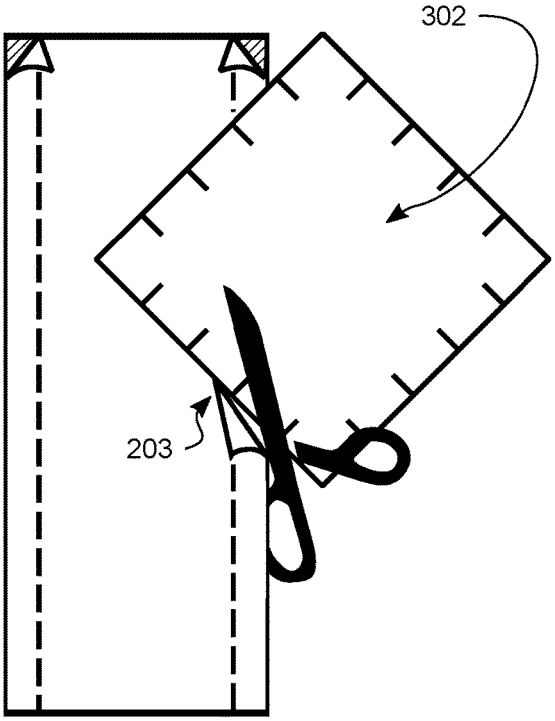
FIG. 3B (Prior Art)
Figure 3C:
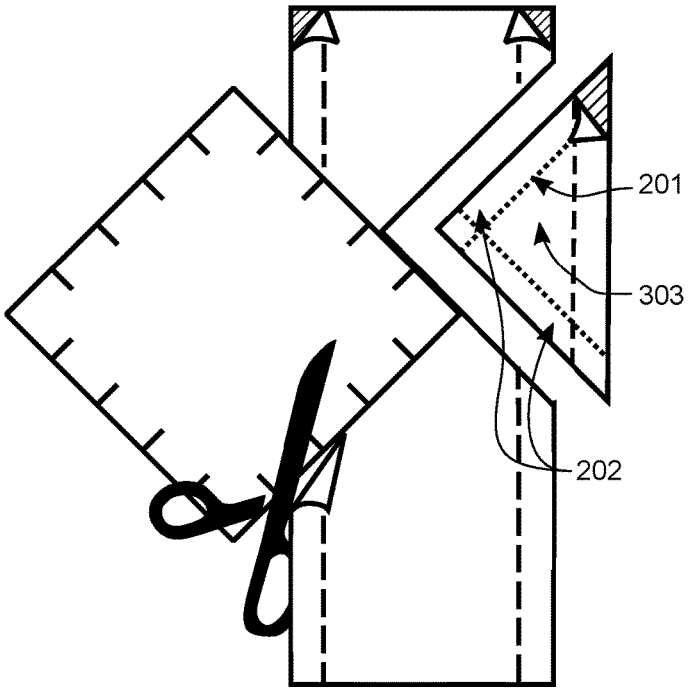
FIG. 3C (Prior Art)
Figure 3D:
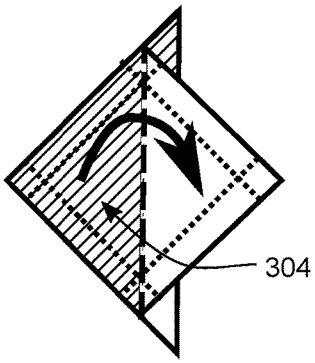
FIG. 3D (Prior Art)

FIG. 3A-3D show the method of assembling Half Square Triangles using a particular variation of the prior art of strip piecing termed a strip tube. In FIG. 3A two strips of fabric are joined together following the considerations shown in FIG. 1. The minimum width of the gap between the two stitched lines 301 is selected to be equal to or greater than one half of the length of the diagonal dimension of the desired Half Square Triangle finished size, without including a seam allowance 102. Per FIG. 3B a ruler 302 is placed on the strip assemblage at a 45° angle relative to the longitudinal edge of the strip tube. The ruler is aligned so that markings on each side align with the stitch line at a position corresponding to the finished side dimension of the desired Half Square Triangle plus two times the seam allowance. Per FIG. 3B cuts 203 are made along the edges of the ruler to release the first half-square triangle component 303 shown in FIG. 3C. The ruler is then moved to the opposite side of the fabric strip, FIG. 3C, and aligned along the stitch line as before, and simultaneously along one of the edges formed when the previous Half Square Triangle was released. Additional cuts are made, repeating the steps above, until no more complete Half Square Triangles may be released. Each released Half Square Triangle may be opened up 304 to form the finished patchwork component as shown in FIG. 3D. A drawback of this method is that it is limited to the fabrication of Half Square Triangles. In common with strip piecing, a second drawback that it is difficult to sew long strips together in a parallel configuration without small variations in width which lead to singular and cumulative errors which have a deleterious effect on the aesthetic quality of a finished quilt.

Figure 4A:
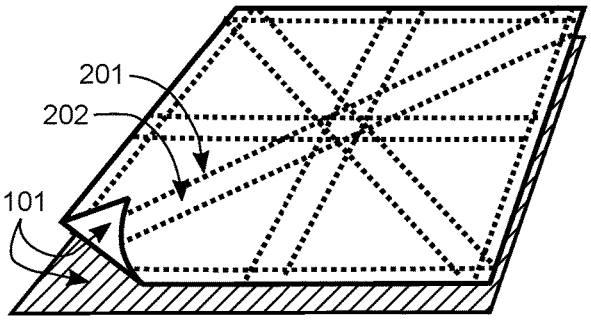
FIG. 4A (Prior Art)
FIG. 4A-4E illustrate a sequence for creating a plurality of Half Square Triangle patchwork components.
Figure 4B:
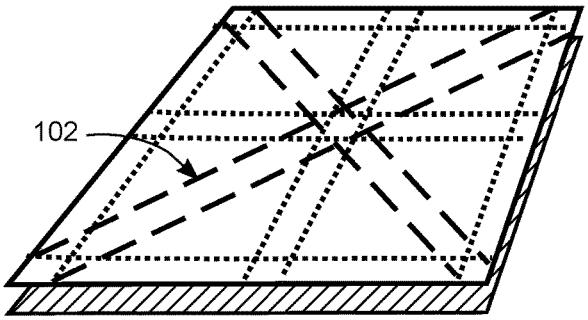
FIG. 4B (Prior Art)
Figure 4C:
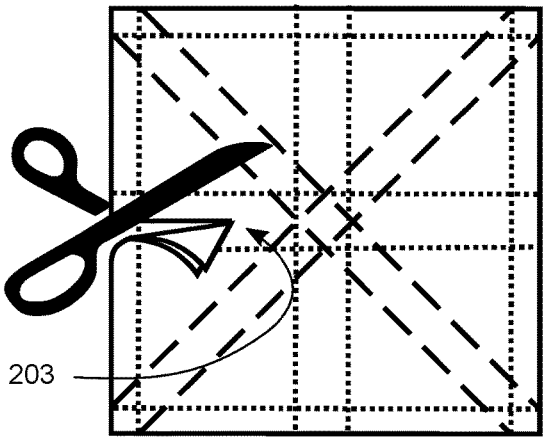
FIG. 4C (Prior Art)
Figure 4D:
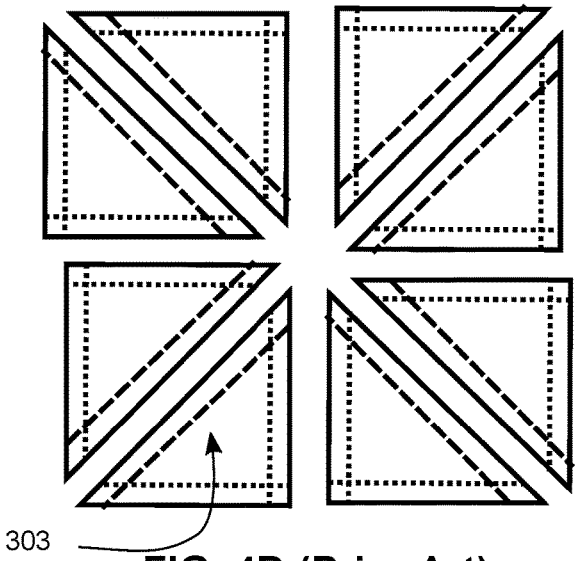
FIG. 4D (Prior Art)
Figure 4E:
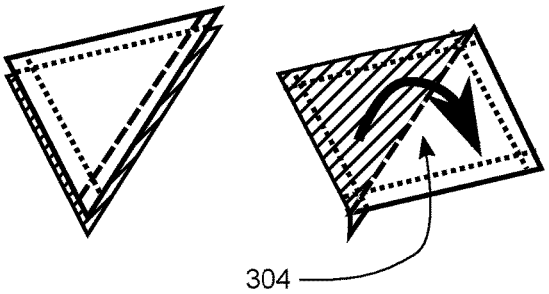
FIG. 4E (Prior Art)

FIG. 4A 4E illustrate another sequence for creating a plurality of the specific patchwork component termed a Half Square Triangle. Per FIG. 4A one square piece of fabric is placed on top of another with presentation sides 101 facing each other. Per FIG. 4B the fabric pieces are stitched together 102 along anticipated diagonal lines of stitching 201 separated by two times an anticipated seam allowance 202 (shown in FIG. 4A). Per FIG. 4C once four lines of stitching are completed the assemblage is cut horizontally and vertically 203 at locations corresponding to anticipated future lines of stitching 201, and their associated seam allowances 202 to release eight first half-square triangle components 303 shown in FIG. 4D. Per FIG. 4E these are opened up 304 to form the finished Half Square Triangle patchwork components. This method has the drawback that it is limited to the fabrication of a single patchwork component, Half Square Triangles.

Figure 5A:
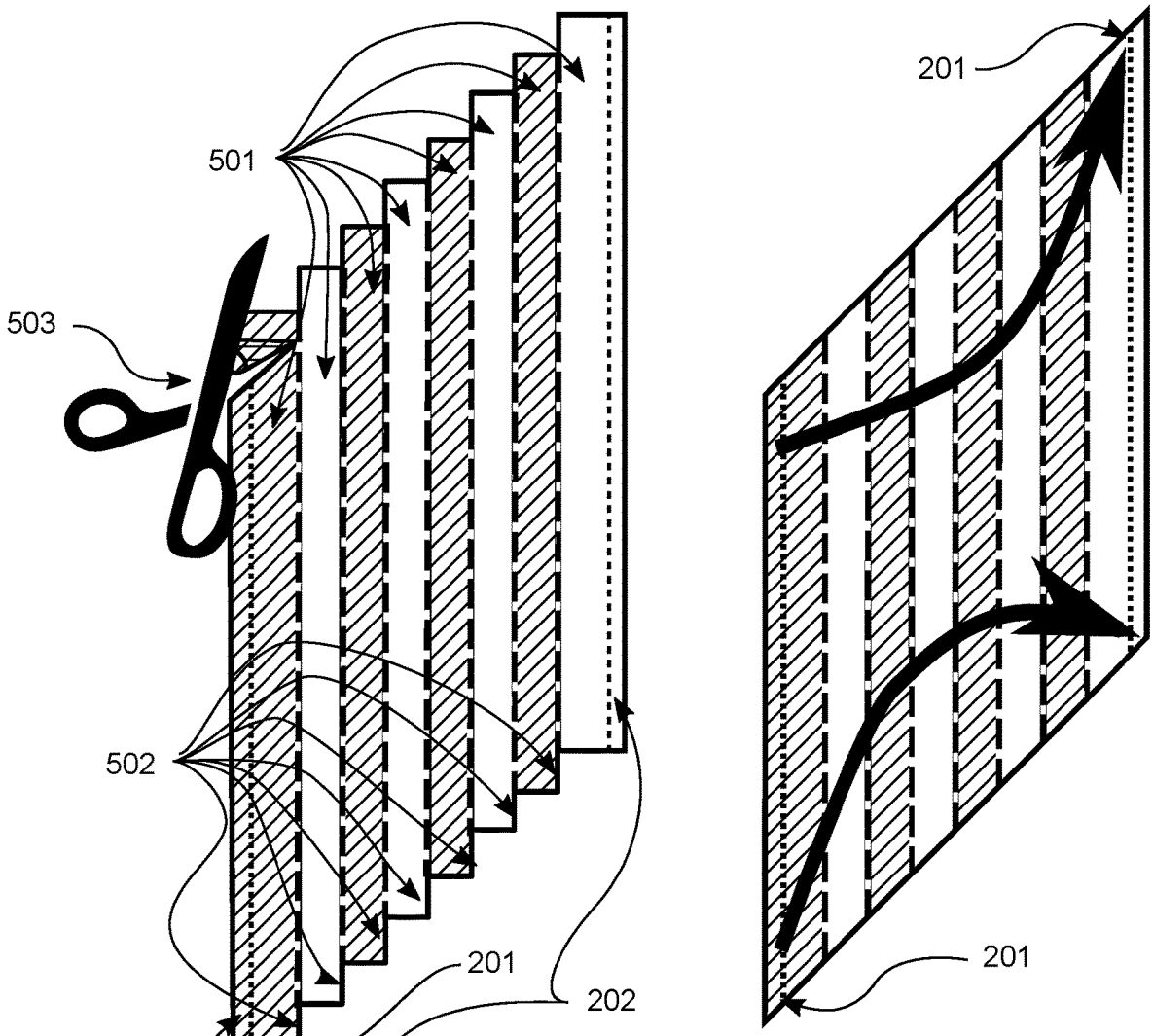
FIG. 5A (Prior Art)
FIG. 5A-5H illustrate a sequence for creating a plurality of components comprised of linear arrays (rows) of Half Square Triangle, Pinwheel or Chevron patchwork components according to a particular variation of the prior art of strip piecing.
Figure 5B:
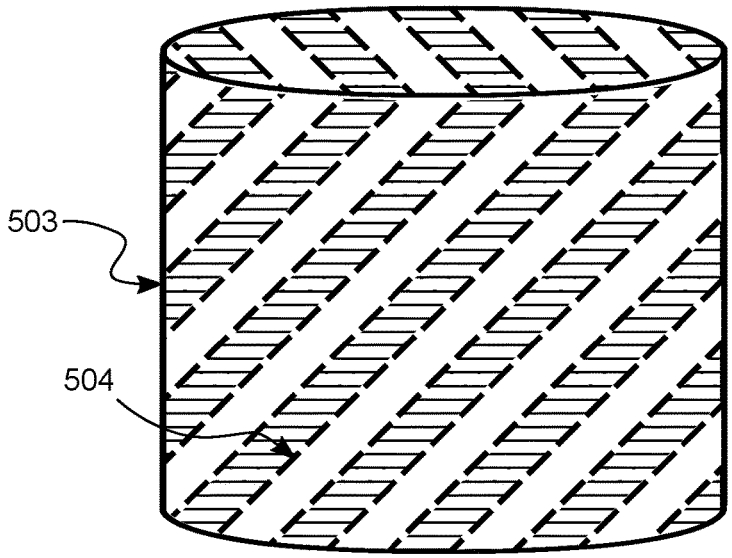
FIG. 5B (Prior Art)
Figure 5C:
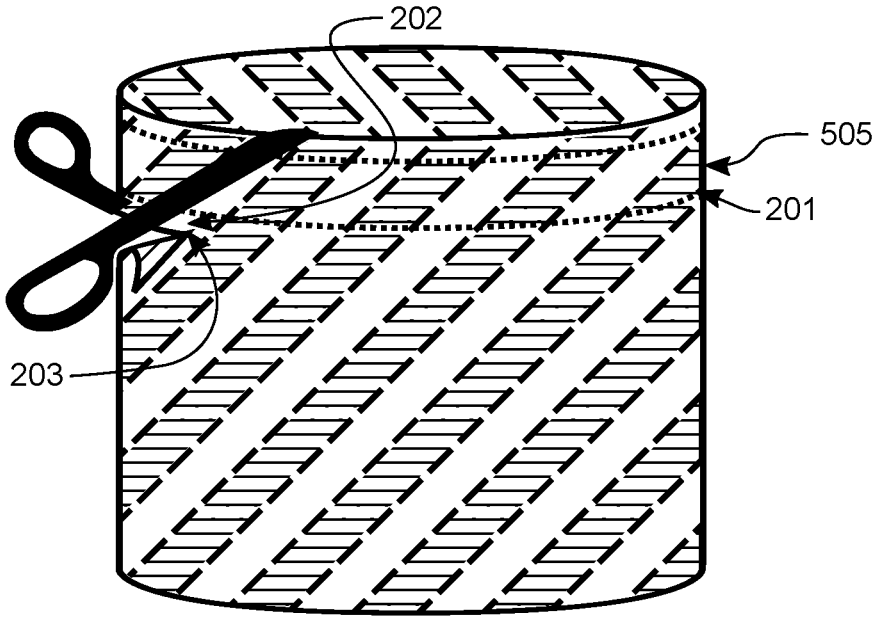
FIG. 5C (Prior Art)
Figure 5D:
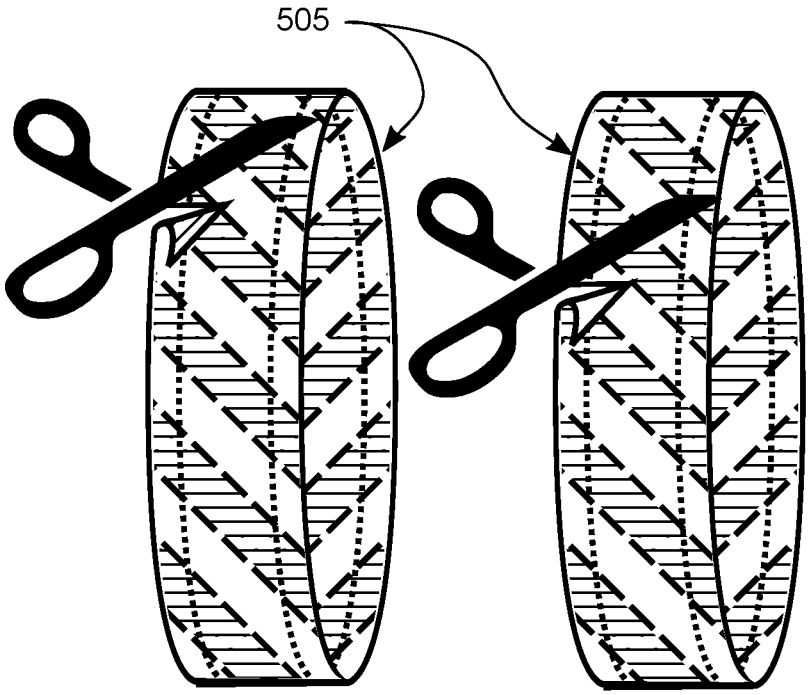
FIG. 5D (Prior Art)
Figure 5E:
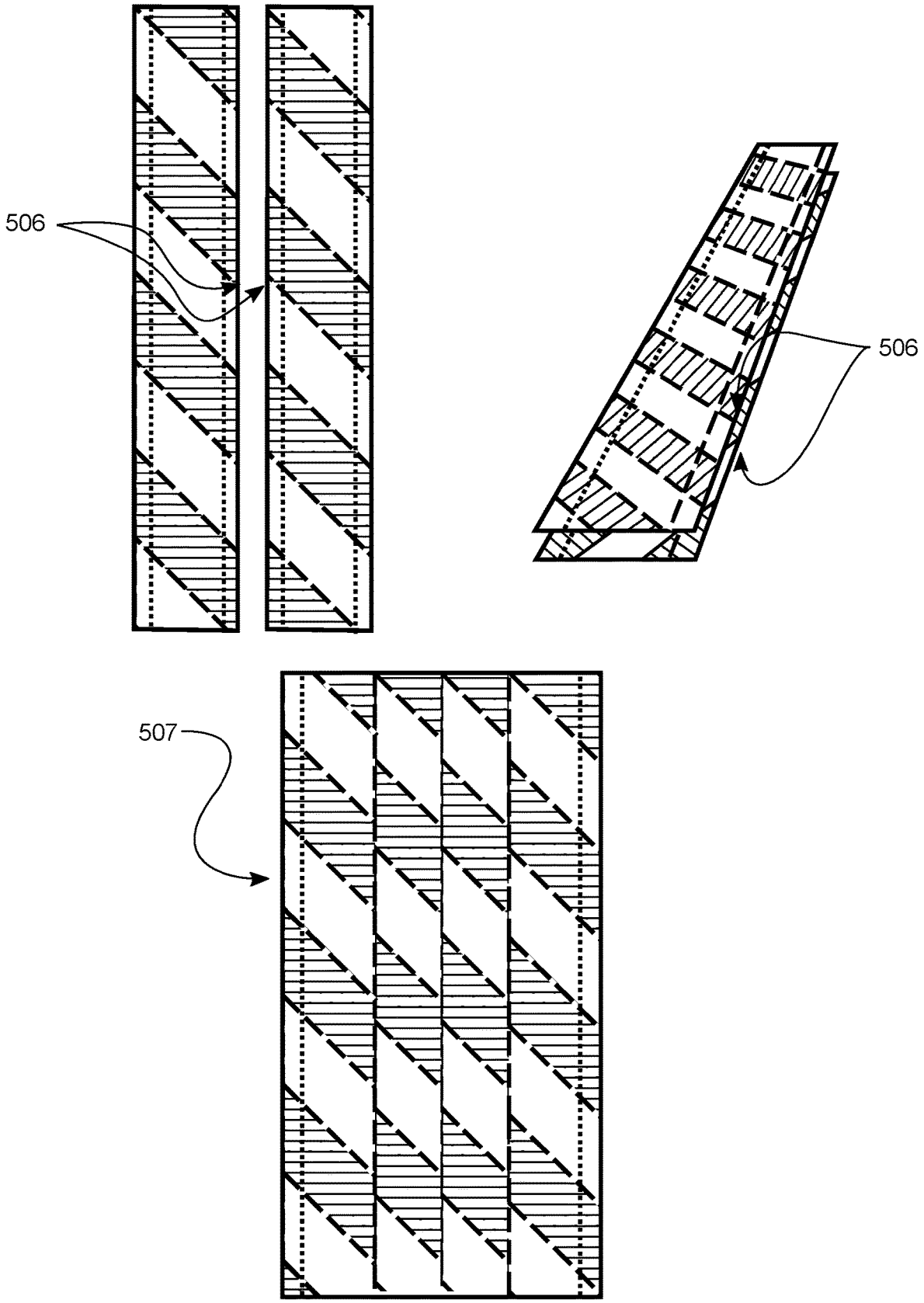
FIG. 5E (Prior Art)
Figure 5F:
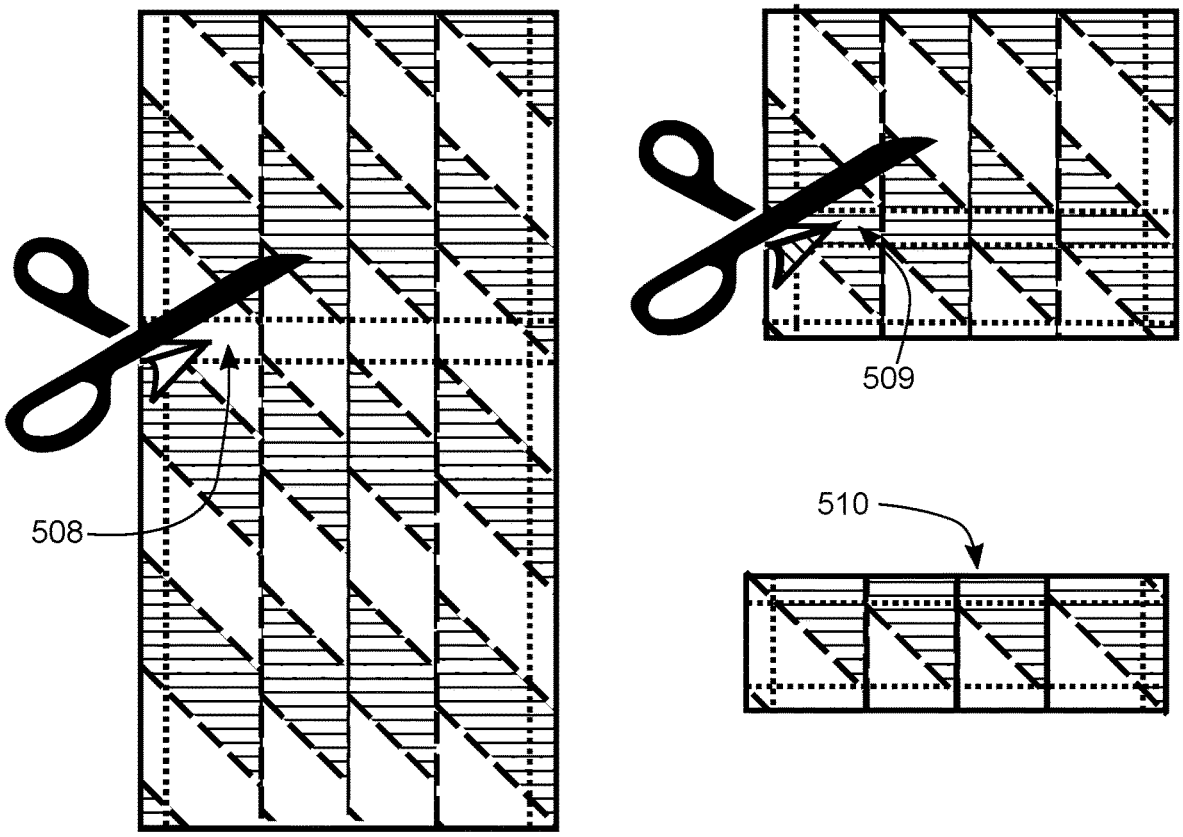
FIG. 5F (Prior Art)
Figure 5G:
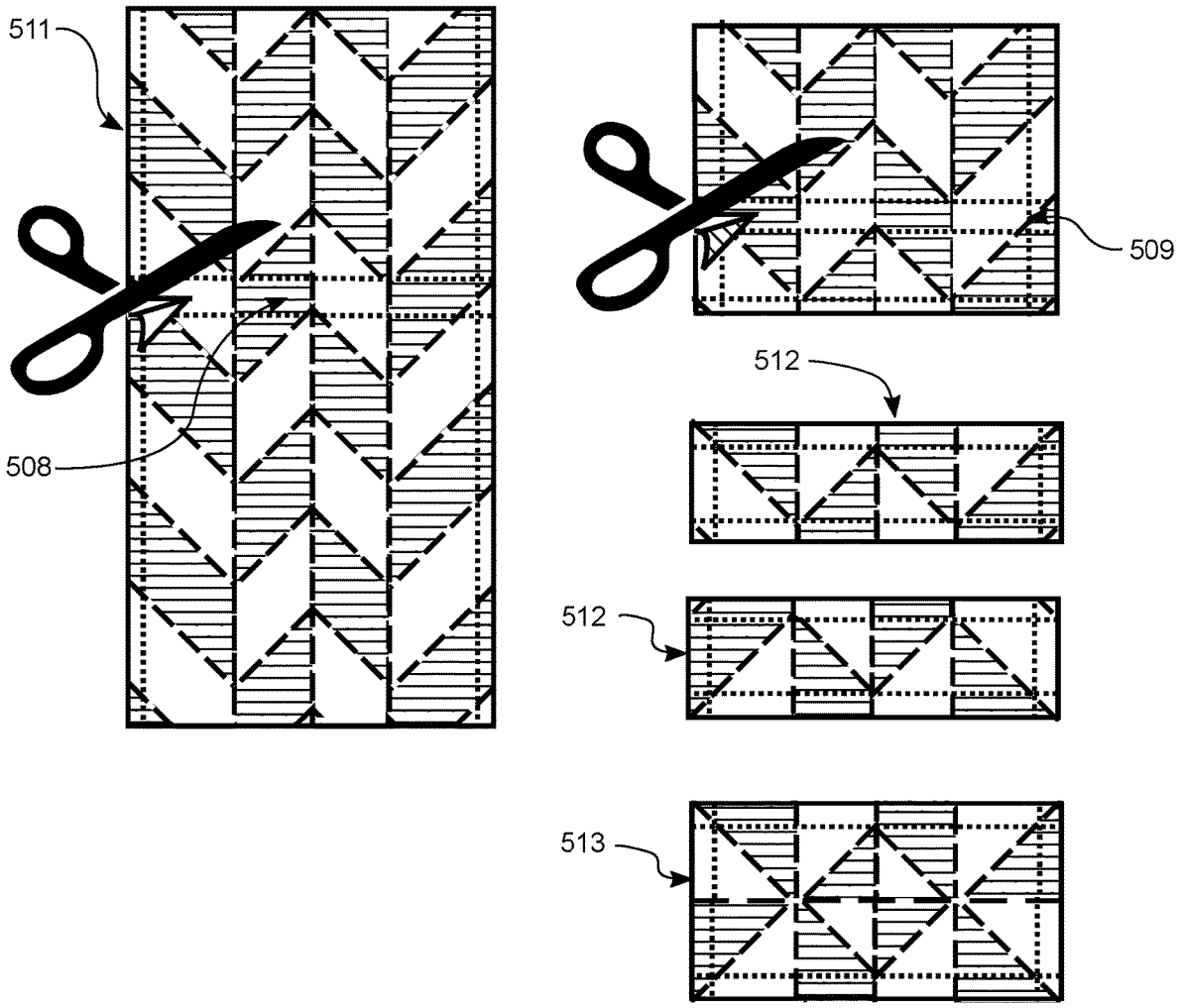
FIG. 5G (Prior Art)
Figure 5H:
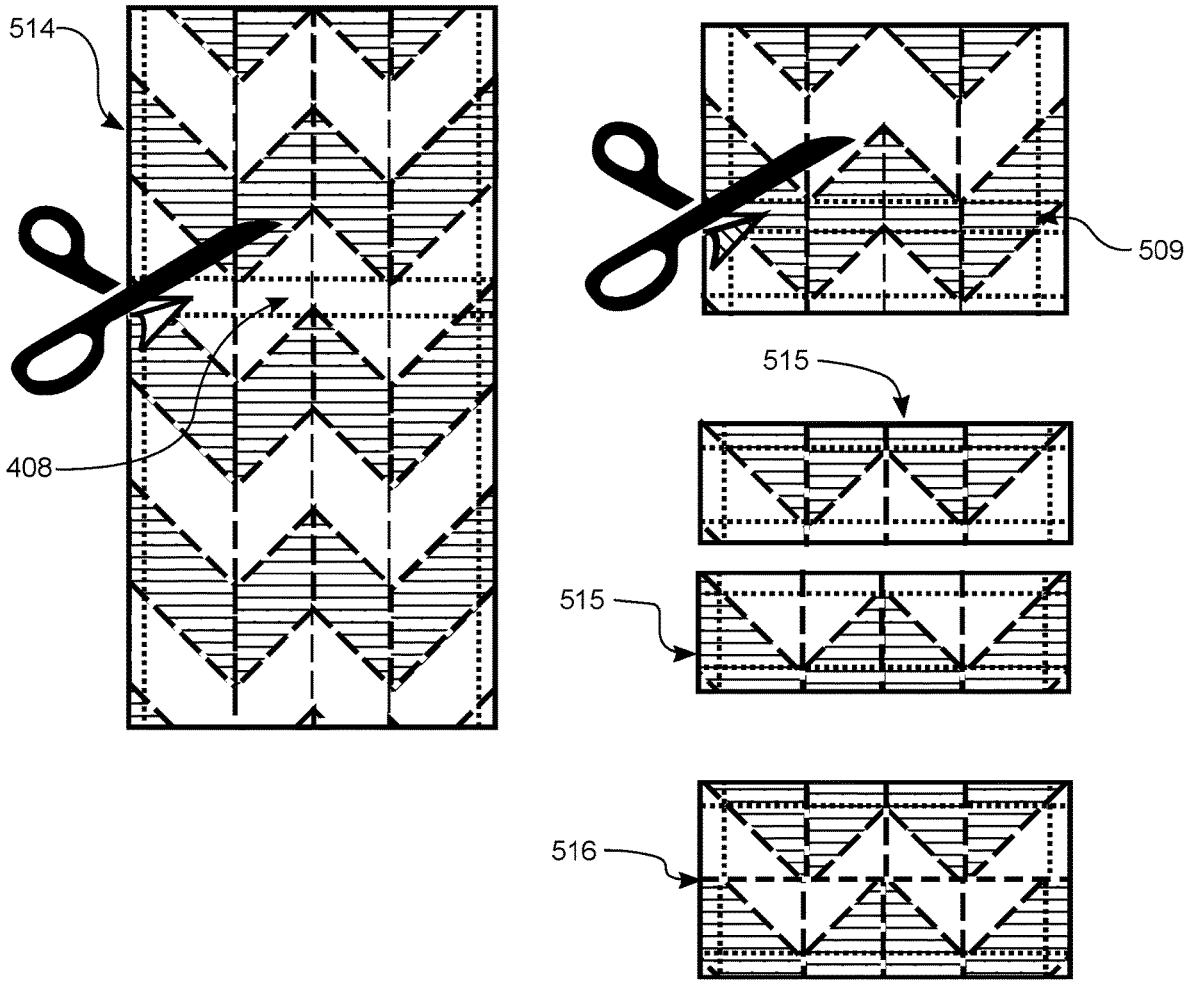
FIG. 5H (Prior Art)

FIG. 5A 5H illustrate a sequence for creating a plurality of linear arrays (rows) of Half Square Triangle and selected other patchwork components using a particular variation of the prior art of strip piecing, also termed tube piecing. In FIG. 5A multiple strips of fabric, typically between 4 and 8, are joined together following the considerations shown in FIG. 1. The width of the strips between the joining stitches 501 is selected to be equal to one half of the length of the diagonal dimension of the desired geometric pattern finished size without including a seam allowance. The outermost strips are sized to anticipate a future line of stitching 201 and its associated seam allowance 202. The strips are offset 502 in anticipation of trimming the traverse edges of the assembled strips at a precise angle, in this example 45 degrees 503. In FIG. 5B the opposing longitudinal edges are joined together along previously identified lines of stitching 201 following the considerations shown in FIG. 1. The resulting shape of flexible fabric is turned inside out to reveal the final presentation side of the fabric and rearranged to form a primary tube 503 with the joining sewing 504 aligned diagonally across the tube. In FIG. 5C the primary tube is cut into smaller secondary tubes 505 with the cut being perpendicular to the longitudinal edge and with a width selected to be the desired width of the final patchwork component plus two times a seam allowance. The secondary tubes are then cut, FIG. 5D, and joined together, FIG. 5E, following the considerations shown in FIG. 1 with the provision that the strips are aligned so that the seams of the original strips exactly meet at the edge of the secondary tubes 506. Continuing in the same manner, several secondary tube strips, typically between 4 and 8, are joined to form a composite unit 507. Per FIG. 5F the composite unit is cut into final patchwork components by cutting perpendicular to the longitudinal edge along a line which bisects the gap between the points visible on the internal seams 508. By virtue of aligning the seams of the original strips to meet at the edge of the secondary tubes as they were assembled 506 the gap should be equal to two times the seam allowance. Cutting between alternate gaps, 508 and 509, yields a final patchwork component 510 comprised of multiple Half Square Triangles aligned in a linear fashion with a peripheral seam allowance.

In one variation of this technique two primary tubes 503 are prepared as mirror images of each other with respect to the angle of the strips of fabric. Secondary tubes 505 are again cut from the primary tubes. Per FIG. 5G secondary tubes are joined in pairs 506 one taken from each primary tube and positioned so that the strips of fabric are aligned to form points of alternating fabric in a composite unit 511. Cutting between alternate gaps, 508 and 509, on secondary tubes derived from the two primary tubes creates a series of intermediate patchwork components 512. When intermediate patchwork components from each of the two types of secondary tubes are joined following the considerations of FIG. 1 the result is a final patchwork component 513 comprised of multiple Pinwheels aligned in a linear fashion with a peripheral seam allowance. In a second variation, per FIG. 5H secondary tubes are joined in pairs, one taken from each primary tube and positioned so that the strips of fabric are aligned to form points of matching fabric in a composite unit 514. Cutting between alternate gaps, 508 and 509, on secondary tubes derived from the two primary tubes creates a series of intermediate patchwork components 515. When intermediate patchwork components from each of the two types of secondary tubes are joined following the considerations of FIG. 1 the result is a final patchwork component 516 comprised of the geometric pattern known as Chevrons aligned in a linear fashion with a peripheral seam allowance.

One drawback of this method is that the versatility of utilizing the patchwork components in assembly of quilt blocks and quilts is limited by the fact that they are already assembled in linear arrays. A second drawback is that the method does not provide orderly steps to create a series of increasingly complex patchwork components of the same shape, thereby limiting the scope of aesthetic objectives for the user. A third drawback of this method is that it is difficult to sew long strips together in a parallel configuration without small variations in width. This difficulty is compounded by the fact that the technique requires that this be done several times. The cumulative small variations cause a loss of precision in the geometric patterns of the patchwork components which are cut from the strip piecing composite, leading to the errors previously discussed.

Turning now to my invention, for the purposes of promoting an understanding of the principles of my invention reference will now be made to certain embodiments and specific language will be used to describe the same. It will nevertheless be understood that no limitation of the scope of the invention is thereby intended with respect to alterations, further modifications and applications of the principles of the invention as described herein as would normally occur to one skilled in the art to which this invention relates.

The invention generally relates to a method for preparing a series of related sewing guide patterns suitable for constructing groups of patchwork components. A user familiar with the invention will select two parameters, a number of internal sewing guide elements placed inside an outer rectangle perimeter and a cutting scheme which will be applied to release the patchwork components. The role of these two parameters are explained below. The user selects the number of internal sewing guide elements based on aesthetic considerations for the complexity and appearance of the patchwork components. The user selects a shape and size of the patchwork component which will conform to anticipated incorporation into a larger assembly such as a quilt block or quilt.

Figure 6A:
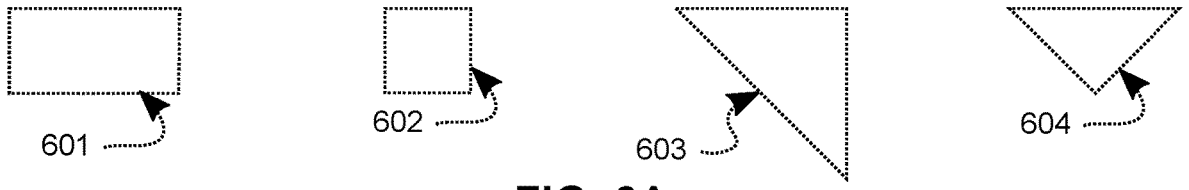
FIG. 6A-6B illustrate patchwork component shapes and how they are incorporated into a rectangular outer perimeter in the present art.

Referring to FIG. 6A in a first step the peripheral shape of the finished patchwork component is selected from among the shapes of a rectangle (601 and 602, where the example 602 is a square and is a special instance of a rectangle), a right-angle triangle 603 or an isosceles triangle 604 (the example shown is a right angle triangle and is a special instance of an isosceles triangle). In a second step the size of the shape is selected to be consistent with anticipated incorporation of the patchwork component into a larger assembly such as a quilt block or quilt. Typically the shortest side of the shape is selected to be between 2" and 16" as is common in assembling patchwork components into quilting blocks. Smaller sizes limit the number of internal sewing guide elements incorporated into the overall sewing guide pattern in subsequent sewing guide pattern preparation steps explained below, and it is understood that there is no upper bound to the size limit other than user skills in applying means known in the art as foundation piecing to execute the pattern using a digital embroidery machine, paper piecing or fabric foundation piecing.

Figure 6B:
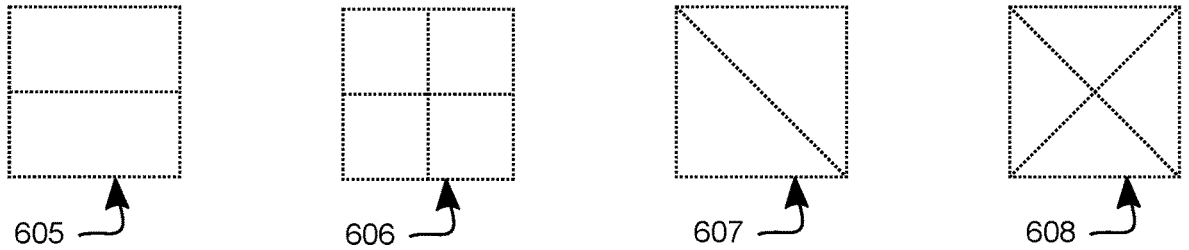

Referring to FIG. 6B, in a third step a rectangular pattern is then prepared which exactly contains multiple congruent instances of the selected patchwork component shape and is either exactly two congruent rectangles sharing a side of equal length 605, or four congruent rectangles sharing a common corner with adjacent rectangles sharing sides of equal length 606 (where the example is a square and is a special instance of a rectangle), or two congruent right angle triangles sharing a diagonal side 607, or four congruent right angle triangles sharing a common apex 608, or four congruent isosceles triangles sharing a common apex 608. In the case of isosceles triangles two of the triangles will be of the selected shape, and the other two will be used to fill in the rectangle. Thus, the final two triangles will share sides of equal length with the selected isosceles triangle and have an angle between the base and the shared sides equal to 90 degrees minus the angle between the base and shared sides of the selected isosceles triangle.

Figure 7:
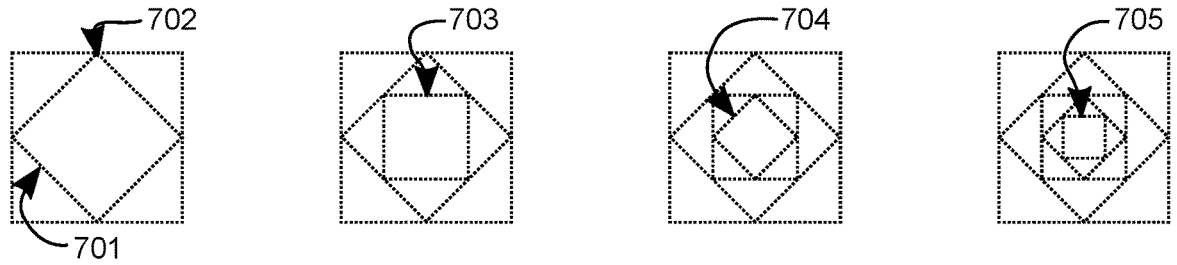
FIG. 7 illustrates the addition of new sewing elements inside the rectangular outer perimeter in the present art.

Referring to FIG. 7 in a fourth step the first member of the series of related patterns is prepared by placing a rhombus 701 inside the rectangle with the points of the rhombus 702 placed at the midpoints of the sides of the rectangle. It is understood that the congruent instances of patchwork components depicted in FIG. 6B remain present inside the rectangle and are not shown in FIG. 7 for the sake of simplicity. In a fifth step the series may be continued by sequentially adding new elements (703, 704, 705), which hereafter alternate between rectangles and rhombuses, inside the initial rhombus where in each case the points of each new element are placed at the midpoints of the sides of the immediately preceding element. The user selects the number of sewing guide elements to be added based on aesthetic considerations for the finished patchwork component. Typically the number of additional sewing elements placed inside the initial rhombus is between 0 and 4; however, there is no upper limit to the series provided that the innermost sewing element is at least two times the user selected working seam allowance.

Figure 8A:
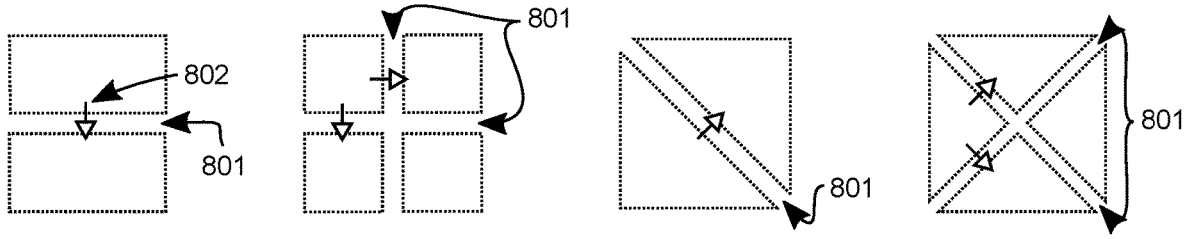
FIG. 8A-8C illustrate the addition of spacing equal to two times a seam allowance between the patchwork components contained within the rectangular outer perimeter in the present art.

Referring to FIG. 8A in a sixth step space 801 equal to two times a seam allowance is added between the sewing guide elements corresponding to the contiguous patchwork component shapes contained within the rectangular patterns of FIG. 6B, which in preferred configurations is approximately ¼", but which may range from 3/16" to 1". As shown in FIG. 8A, when the patchwork components are rectangular, or are isosceles right triangles, the shapes are moved in a direction 802 orthogonal to their shared side until the desired space is created.

Figure 8B:
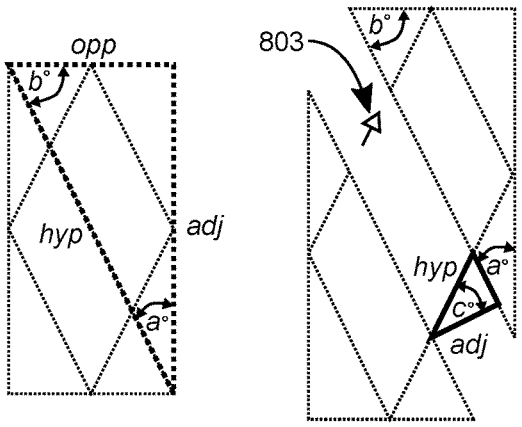

Referring to FIG. 8B, when the patchwork components are right angle triangles with unequal sides then the shapes are moved in a direction 803 parallel to the sides of the lines of the added rhombus sewing guide elements which cross the boundary between the patchwork component shapes. This direction is not orthogonal to the shared sides of the component shapes, and therefore a calculation must be applied to determine how far to move the shapes in order to create the desired space of two times a seam allowance between the shared sides. An exact solution can be obtained using trigonometry. Considering the right triangle formed by the diagonal bisection of the outer perimeter rectangle angle a° can be determined using the standard trigonometric function arctangent applied to the ratio opp/adj. Then b° is equal to 90°−a°. From basic trigonometric considerations, angle c° is equal to the absolute difference between a° and b° (expressed as |a°-b° |). Knowing c°, the distance that the shapes must be moved apart to create a space equal to two times a seam allowance can be computed from standard trigonometry as:

distance shapes must be moved apart=two times the seam allowance/cosine(c°)

Figure 8C:
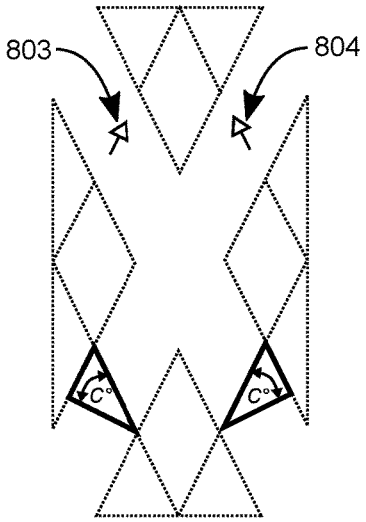

Referring to FIG. 8C, when the patchwork components are isosceles triangles then the shapes are again moved in directions 803 and 804 parallel to the sides of the lines of the added rhombus sewing guide elements which cross the boundary between the patchwork component shapes. By again considering the right triangles formed by the diagonal bisections of the outer perimeter rectangle angle an angle c° can be determined, from which the distance the shapes must be moved apart can be determined using the computation previously described.

In completing the sixth step it is understood that the space is also added to the additional internal elements depicted in FIG. 7 which are not shown in their entirety in FIG. 8 for the sake of simplicity.

Furthermore, as a matter of convenience, in a seventh step, for each side of the rectangular base pattern or added internal pattern elements gaps that are orthogonal to the sides of the patchwork component shapes where the space is added, a straight line segment may be added between the endpoints on either side of the separation to bridge the space. This facilitates the assembly of patchwork components by allowing continuous stitching along the lines of the final sewing guide pattern; however, stitching may be stopped and restarted on either side of the added space without deleterious effect on the patchwork component assembly.

Figure 9A:
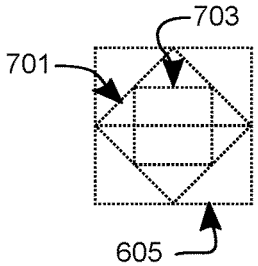
FIG. 9A-9C provides an illustrative example of how the separation between the patchwork components is also applied to the new sewing elements that were added, and as a matter of convenience straight line segments are added between the endpoints of the rectangular base sewing guide pattern and added sewing guide elements gaps that are orthogonal to the sides of the patchwork component shapes on either side of the separation.
Figure 9B:
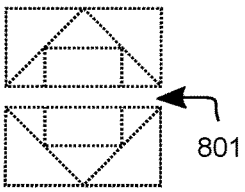
Figure 9C:
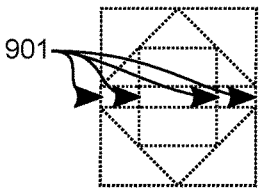

An example of the concepts of the sixth and seventh steps is shown in FIG. 9. Referring to FIG. 9A the example consists of a rectangular pattern containing two rectangular patchwork component shapes 605, to which two internal elements 701 and 703 have been added. Referring to FIG. 9B the rectangle and the added internal elements are separated 801 by a space equal to two times a seam allowance. Referring to FIG. 9C straight line segments 901 may be added between the endpoints on either side of the separation of the rectangular base sewing guide pattern and the added sewing guide element sides that cross the shared sides of the patchwork component.

Figure 10:
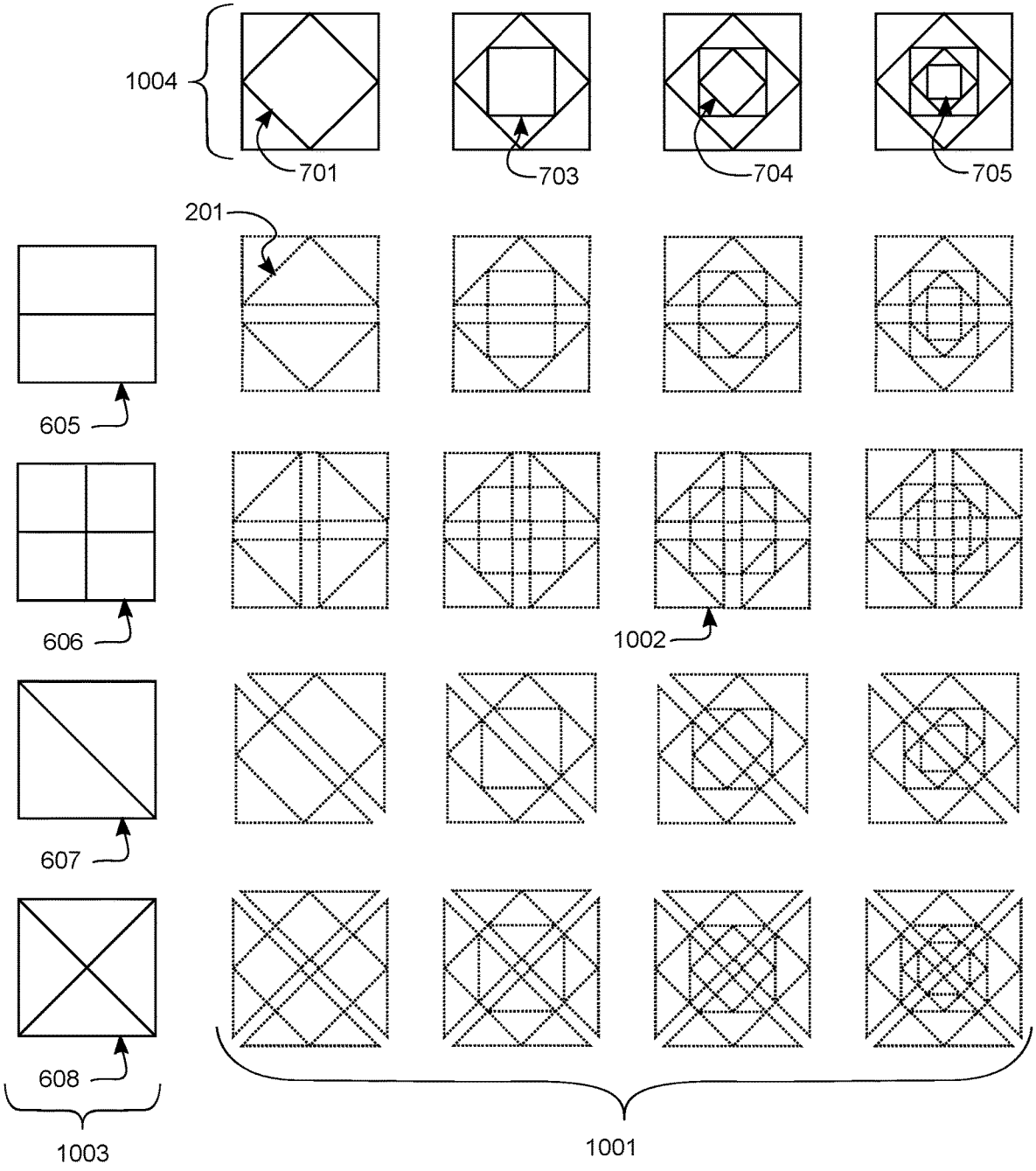
FIG. 10 illustrates representative members of the inventive patterns and how they are derived.

It will be understood that completion of these steps results in a related series of final sewing guide patterns for constructing a plurality of patchwork components. FIG. 10 illustrates representative members of this series 1001, including illustrative pattern 1002, and how they are derived from the preparation of a rectangular pattern which exactly contains multiple congruent instances of the peripheral shape of selected finished patchwork components 1003 and the addition of internal pattern elements 1004, followed by addition of space between contiguous patchwork components according to the concepts displayed in FIG. 8 and FIG. 9. In viewing FIG. 10 it shall be understood that the representative patterns shown are based on a square which is a special instance of a rectangle, and that this is not intended to exclude or limit selection of any other rectangular patterns.

Figure 11:
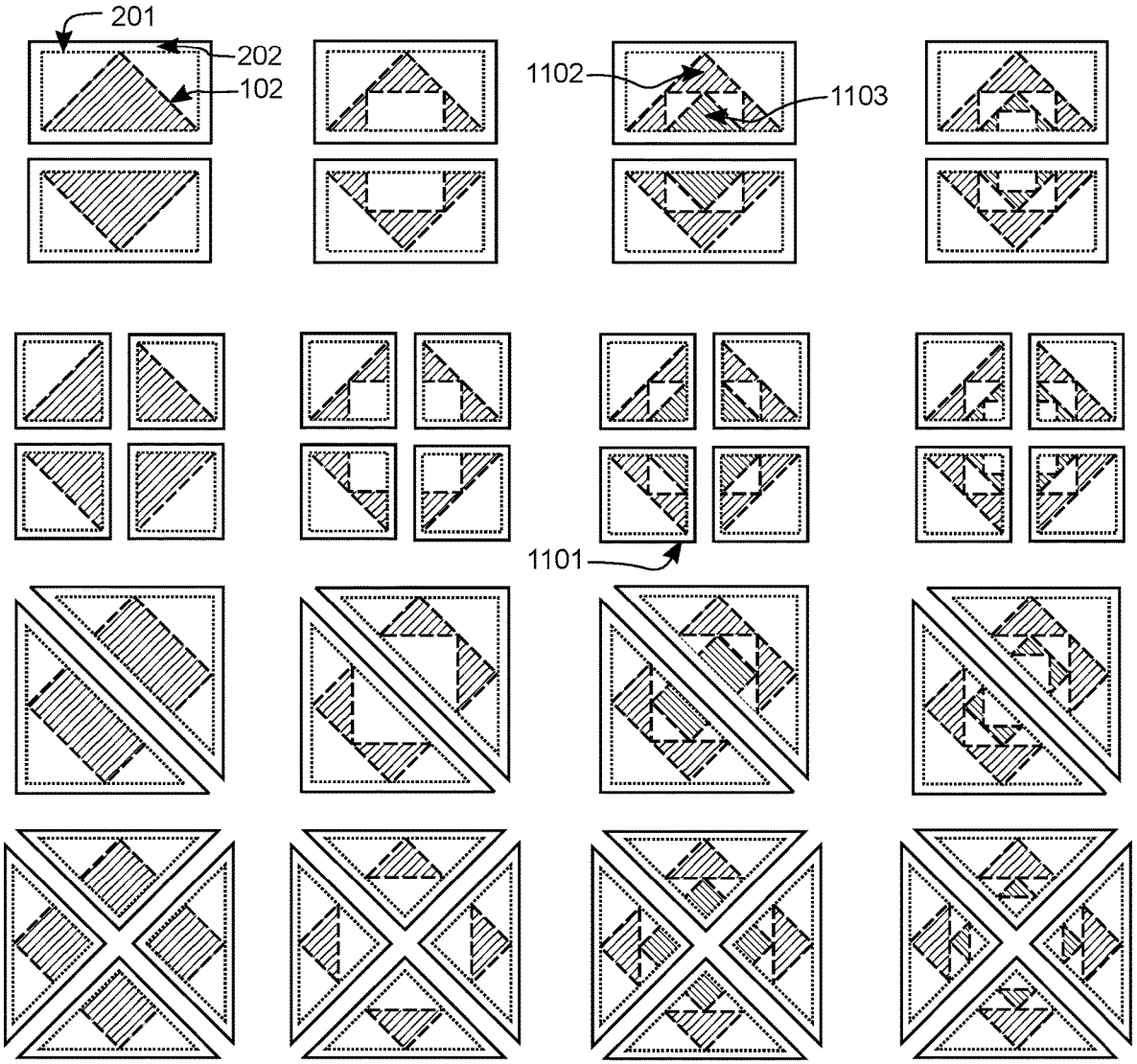
FIG. 11 depicts an illustrative array of pluralities of patchwork components which can be prepared using the inventive method.

By using one of my inventive sewing guide patterns a user is able to assemble, by methods generally known in the art as foundation piecing, a plurality of selected patchwork components. FIG. 11 depicts an illustrative array of pluralities of patchwork components, corresponding to representative members of the series 1001, including illustrative patchwork components 1101, which can be prepared using the inventive method. It will be understood that fabric patterns 1102 and 1103, and white space, are arbitrary and intended only to illustrate the different portions of the patchwork component. There are no limitations other than aesthetic considerations placed on the user as to fabric patterns to be used to construct a patchwork component. The sewing guide incorporates seams which are no longer than approximately 1 to 2 times the dimensions of the patchwork components and therefore the cumulative errors which have a deleterious effect on the aesthetic quality of the patchwork components associated with other methods which require sewing long strips together is avoided. The user releases individual patchwork components by cutting around the outer perimeter of my sewing pattern, leaving a seam allowance, and generally through the middle of the spaces that were added between the patchwork component shapes. The finished patchwork components have seam allowances on all sides, and there are no limitations on esthetic options available when the user incorporates the patchwork components into quilt designs. The art generally known as foundation piecing may be executed using a digital embroidery machine, paper piecing or fabric foundation piecing. For the purposes of promoting a further understanding of the invention and its preferred features and advantages, reference will now be made to the following specific example in which one of my inventive patterns is used to assemble patchwork components using foundation piecing executed using a digital embroidery machine. It will be understood that this example is given by way of illustration and is not restrictive of the invention.

In this example a user wishes to create finished patchwork components with a peripheral shape of a square 602 with sides of size 6". According to the invention a rectangular pattern 606 is then prepared, in this case a square with sides of 12". In this example the user further elects to add three additional pattern elements 701, 703 and 704 inside the rectangular pattern based on aesthetic considerations for the finished patchwork component. These selections correspond to illustrative patchwork components 1101. Following the additional steps of adding space between the contiguous patchwork component shapes and internal pattern elements, and as a matter of convenience adding a straight line segment to bridge the space for each side of the rectangular base pattern or added internal pattern elements gaps that are orthogonal to the sides of the patchwork component shapes, one arrives at the finished sewing guide pattern 1002. To construct the patchwork components by a means known as foundation piecing executed using a digital embroidery machine the user enters the final sewing guide pattern 1002 as a digitized file to an embroidery machine. As a matter of convenience additional elements consisting of fabric placement guides may also be entered into the embroidery machine at this time.

Figure 12A:
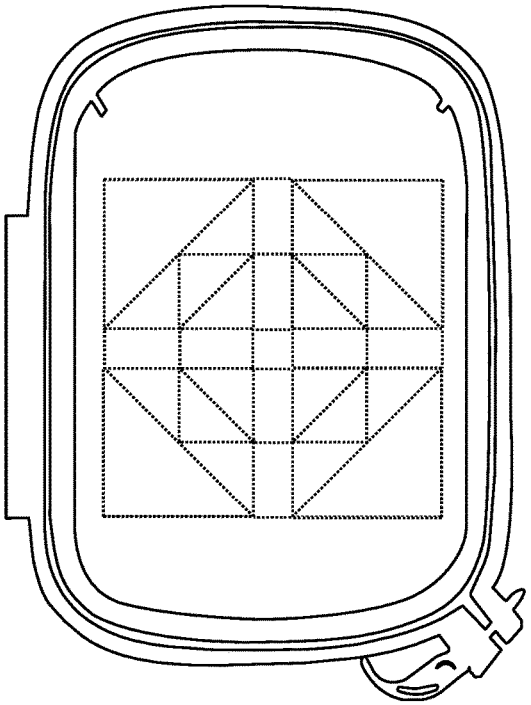
FIG. 12A-12I depicts an illustrative example of construction of two triangular patchwork components using one of the inventive finished sewing patterns in conjunction with a digital embroidery machine.
Figure 12B:
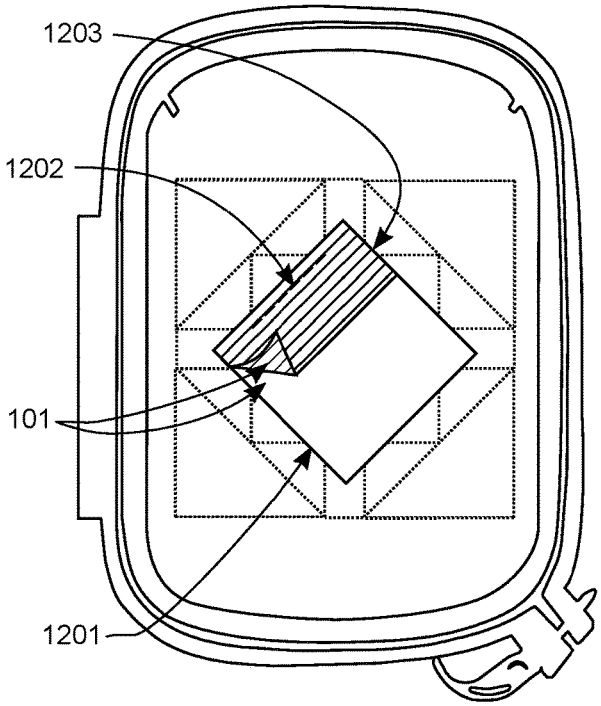
Figure 12C:
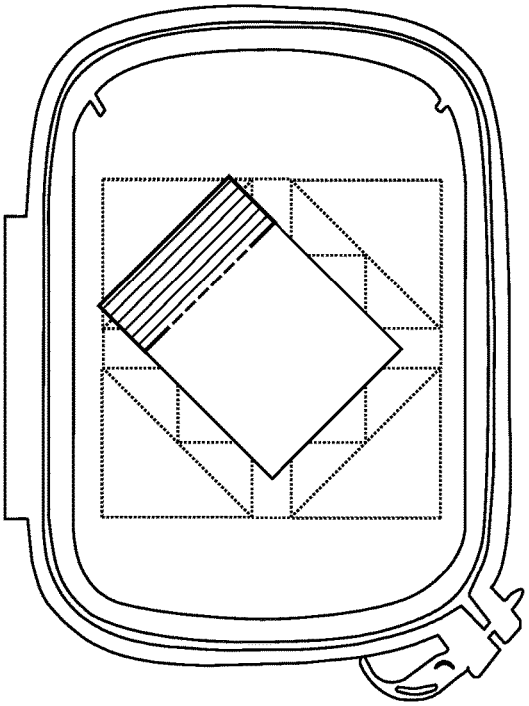
Figure 12D:
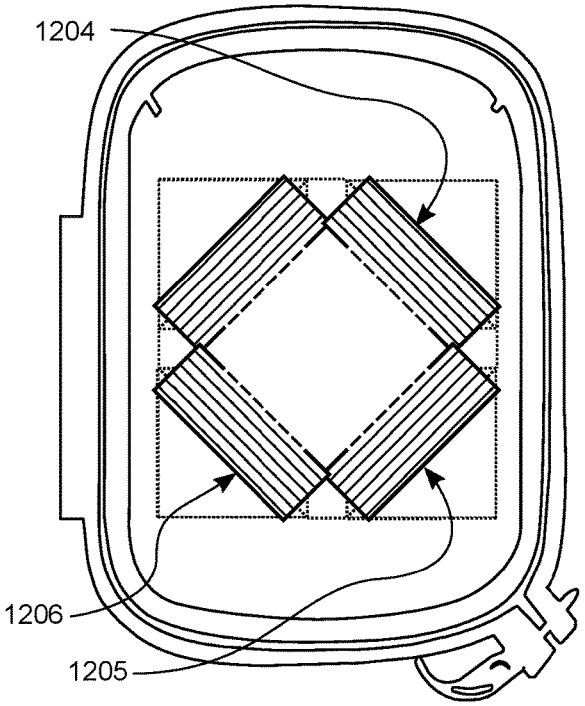

To assemble the patchwork components from the pattern the user first secures a stabilizer substrate in an embroidery hoop where the stabilizer is of a body and weight which can be easily penetrated by a sewing machine. Referring to FIG. 12A the user instructs the embroidery machine to stitch out the sewing guide pattern 1002 and, if entered as a matter of convenience, the fabric placement guides. Referring to FIG. 12B the user then obtains a piece of fabric 1201 which is larger than the innermost sewing guide element of the patchwork component construction sewing guide present on the stabilizing material, and places the fabric with the presentation side 101 up on the stabilizing material over the innermost sewing guide element so that the entire element is covered and the fabric extends beyond the innermost element sewing guides on all sides. The user then selects one side of the innermost sewing guide element and obtains a second piece of fabric 1202 which is larger than the triangle formed by the selected side of the innermost sewing guide element and the adjacent corner of the closest larger sewing guide element. The second piece of fabric is placed presentation side 101 down such that the second piece overlaps with the selected sewing guide of the innermost sewing guide element, and an amount of the second piece sufficient to cover the triangle formed by the selected side of the innermost sewing guide element and the adjacent corner of the closest larger sewing guide element extends from the sewing guide towards the innermost sewing guide element. The user then activates the digitized embroidery file to stitch the two pieces of fabric to the underlying stabilizer together along the selected sewing guide 1203. Referring to FIG. 12C the user then folds the second piece of fabric back over along the joining stitch line to reveal the presentation side. Referring to FIG. 12D these steps are repeated to join new fabric pieces 1204, 1205 and 1206.

Figure 12E:
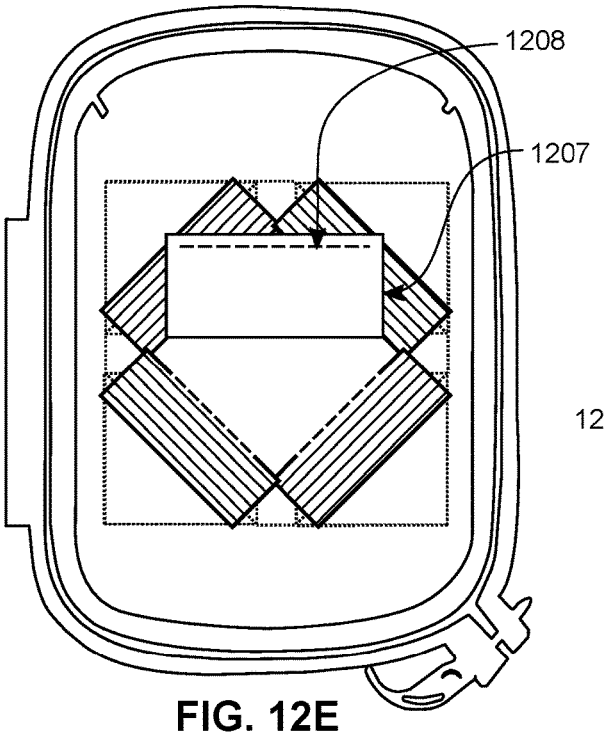
Figure 12F:
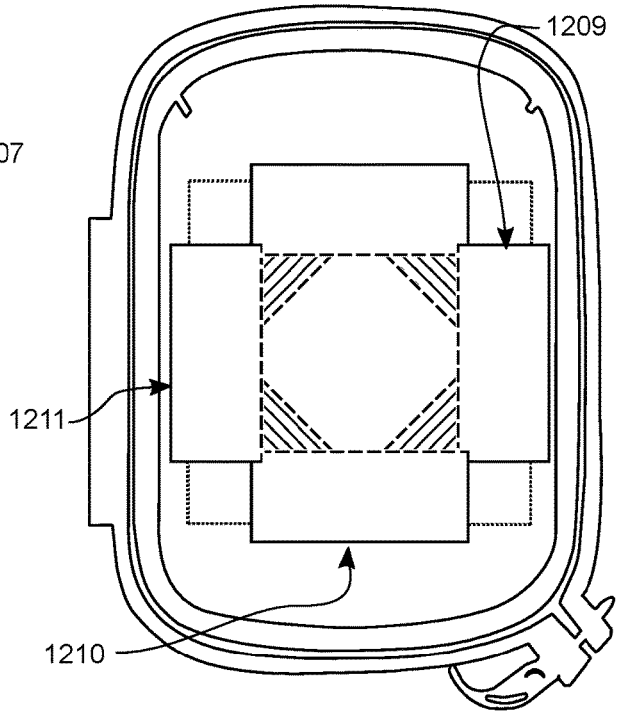
Figure 12G:
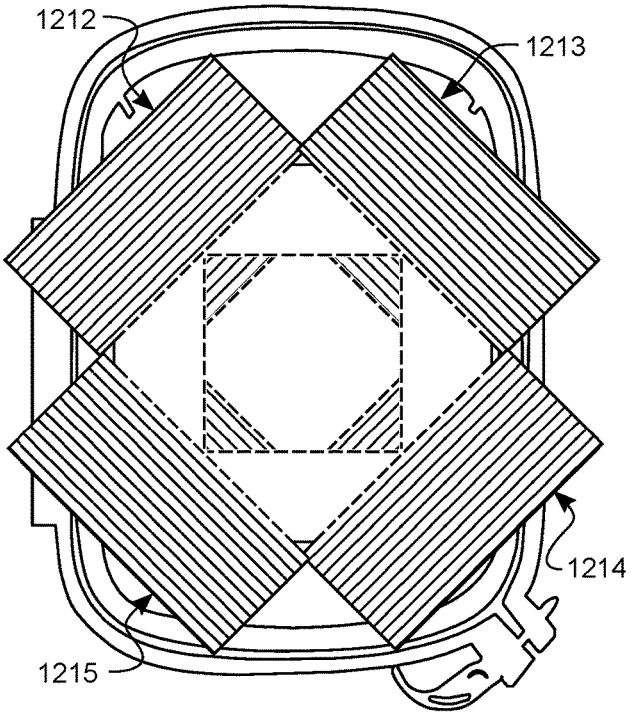

Referring to FIG. 12E the user obtains a new piece of fabric 1207 and joins it to one side of the next innermost sewing guide element 1208 following the steps and considerations that were applied to fabric piece 1202. Referring to FIG. 12F these steps are repeated to join new fabric pieces 1209, 1210 and 1211. Referring to FIG. 12G these steps are repeated to join new fabric pieces 1212, 1213, 1214 and 1215. It will be understood that these steps would be repeated in a similar fashion, moving outward in sequence for as many internal sewing guide elements as any particular final sewing guide pattern contains.

Figure 12H:
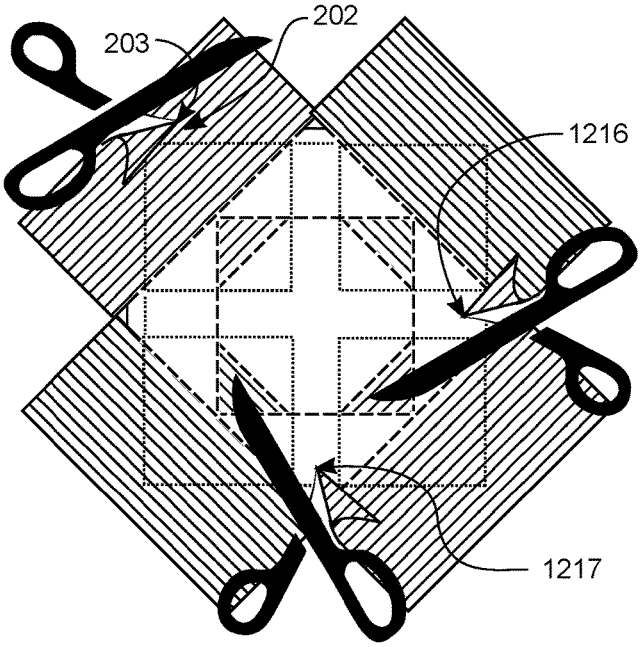

Referring to FIG. 12H the user then releases the stabilizer and fabric piece assembly from the embroidery hoop. The user then trims the outside perimeter of the assembly 203 using the indicated future lines of stitching of the final sewing guide pattern as a guide, and leaving a seam allowance on the external side 202. The indicated future lines of stitching are visible from the reverse side of the assembly as stitches, and can also be perceived by touch. The user then trims between the joined patchwork component assemblies 1216 and 1217 to release the finished patchwork components 1101, shown in FIG. 12I. According to the art the stabilizer may be removed or left in place depending upon the quilt design that the components will be used in.

Figure 13:
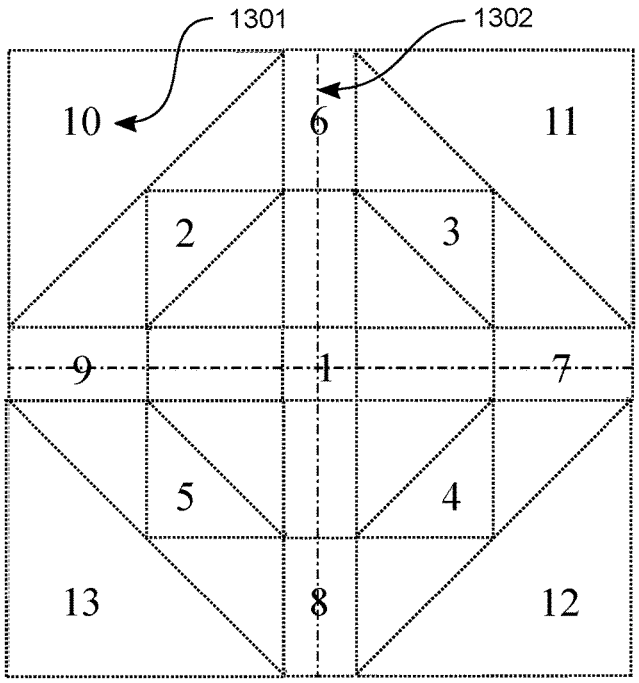
FIG. 13 depicts an illustrative example of one of the inventive finished sewing patterns expressed as a paper piecing pattern.

For the purposes of promoting a further understanding of the invention and its preferred features and advantages, reference will now be made to how the preceding specific example of one of my inventive patterns can be used to assemble exemplary patchwork components 1101 using the art of paper piecing. It will be understood that this example is given by way of illustration and is not restrictive of the invention. Referring to FIG. 13 the illustrative inventive pattern 1002 is printed or drawn on a piece of paper or other suitable substrate. Numbers 1301 consistent with the art of paper piecing instruct the user as to the order in which pieces of fabric are to be placed. Fabric pieces are sized and placed according to the methods described above for foundation piecing using a digital embroidery machine. The pattern includes an indicated cutting line 1302 for releasing the finished patchwork components 1101.

Figure 12I:
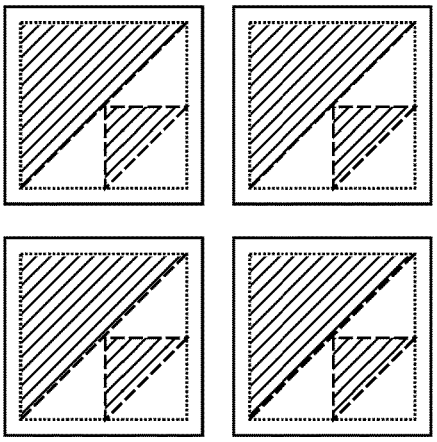

Referring to FIG. 12I the advantages of my invention will now be further illustrated by considering finished patchwork components 1101. Each of these particular finished patchwork components consists of five (5) triangles. Using the inventive method a set of four finished patchwork components 1101 can be constructed rapidly, efficiently and simultaneously using only basic sewing skills. A total of thirteen (13) pieces of square or rectangular fabric pieces were assembled using thirteen (13) stitchings, whereas if the patchwork component was prepared by piecing together elementary fabric pieces a total of twenty (20) pieces would be required and assembled using twenty (20) stitchings. Thus the inventive method required substantially less work. Furthermore, if constructed of elementary fabric pieces all of the pieces would be triangles which have the inherent disadvantage is that it is difficult to prepare quantities of fabric pieces which are identical in their geometric characteristics when the pieces incorporate angles other than right angles. By avoiding the use of elementary fabric pieces in the shapes of triangles the inventive method can be more precise in maintaining geometric characteristics such as length, width and angles between sides, thereby reducing or eliminating single and cumulative errors which can be deleterious to the aesthetic quality of the patchwork components.

Figure 14:
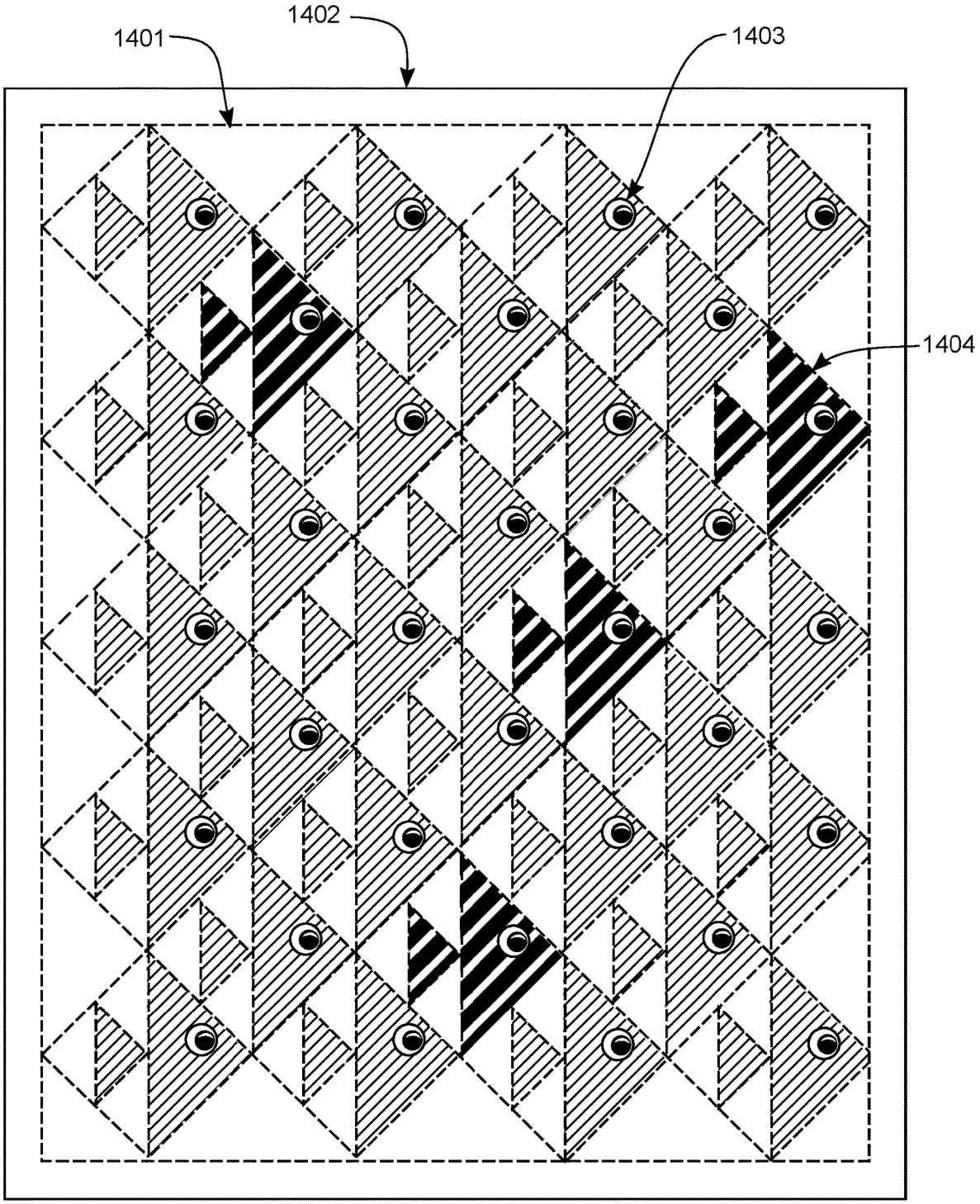
FIG. 14 depicts an illustrative example of a quilt constructed from patchwork components assembled from one of the inventive finished sewing patterns.

Referring to FIG. 14 the advantages of my invention will now be further illustrated by considering an exemplary quilt "One Fish, Two Fish" constructed from the finished patchwork components 1101. The "One Fish, Two Fish" quilt shown in FIG. 14 is a typical small quilt constructed of 32 finished patchwork components 1101, which have been rotated 45° during assembly. Elementary fabric pieces 1401 have been used to fill the sides of the quilt pattern, and a strip border 1402 and non-fabric embellishment eyes 1403 have been added consistent with practices known in the art. For one patchwork assemblage a different fabric pattern 1404 was selected to provide artistic contrast. Heretofore patchwork component 1101 was too labor-intensive when constructed by prior techniques to be recognized and named in the art. Using the inventive technique patchwork component 1101 can now be easily fabricated, and aesthetically pleasing quilts such as "One Fish, Two Fish" are more attainable by practitioners of the art of quilting.

The description of exemplary embodiments of the present invention has been presented for purposes of illustration and description, and is not intended to be exhaustive or limited to the invention in the form disclosed. Many modifications and variations will be apparent to those of ordinary skill in the art. The disclosed embodiments were chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the inventions as disclosed by the claims.

| Patent Number | Issue Date | Patentee |
|---|---|---|
| 4,646,666 | Mar. 3, 1987 | Burrier |
| 5,272,995 | Dec. 28, 1993 | Harger |
| 8,171,867 | May 8, 2012 | Roche |
| 8,851,002 | Oct. 7, 2014 | Gardner |
| 8,967,062 | Mar. 3, 2015 | Gardner |

I claim:

1. A method for preparing a sewing guide pattern for constructing groups of patchwork components for use in quilting, the method comprises the steps of:

a. selecting a finished patchwork component shape from among the shapes of a rectangle, a right-angle triangle and an isosceles triangle;

b. selecting a value for a seam allowance, an area between a fabric edge and a stitching line on at least two pieces of fabric which will be sewn together, where the value is selected from the range of 3/16 to 1 inch;

c. selecting desired dimensions for the sides of the finished patchwork component shape where a shortest side of the shape is selected to be in the range of 2" to 16";

d. preparing a rectangular peripheral guide which contains multiple congruent instances of the selected patchwork component shape which is either two congruent rectangles sharing a side of equal length, or two congruent right angle triangles sharing a diagonal side, or four congruent rectangles sharing a common corner with adjacent rectangles sharing sides of equal length, or four right angle triangles sharing a common apex, or four isosceles triangles sharing a common apex of which two are of the selected shape and the remaining two share sides of equal length with the selected shape;

e. selecting an integer value for a number of sewing elements, where the value is at least one but without an upper bound provided that the innermost sewing element is at least two times the value selected for the seam allowance;

f. placing inside the rectangular peripheral guide a first pattern shape which is a rhombus whose vertices are placed on the midpoints of the sides of the rectangular peripheral guide;

g. when the number of sewing elements is selected to be greater than one, proceeding in a stepwise fashion to place a new pattern shape inside an immediately preceding pattern shape that was placed when the number of sewing elements was one less than for the new pattern shape, such that the vertices of the new pattern shape are placed at the midpoints of the sides of the immediately preceding pattern shape, until a total number of pattern shapes is placed equal to the selected integer value;

h. adding a separation space between the contiguous patchwork component shapes contained within the rectangular peripheral guide equal to two times the seam allowance, as measured orthogonally to the sides of the patchwork component shapes where the space is added, with said space also being applied to the pattern shapes where they intersect the shared sides of the contiguous patchwork component shapes.

* * * * *